US006595905B2

(12) United States Patent
McBride

(10) Patent No.: US 6,595,905 B2
(45) Date of Patent: Jul. 22, 2003

(54) EXERCISER WITH MULTIPLE BUNGEE CORD RESISTANCE AND ENHANCED BENCH MOVEMENTS

(75) Inventor: Robert W. McBride, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 67 days.

(21) Appl. No.: 09/738,317

(22) Filed: Dec. 18, 2000

(65) Prior Publication Data

US 2002/0077229 A1 Jun. 20, 2002

(51) Int. Cl.[7] ..... A63B 21/04
(52) U.S. Cl. ..... 482/130; 482/138; 482/137
(58) Field of Search ..... 482/135, 130, 482/142, 121, 99, 104, 123, 127, 129, 138, 137

(56) References Cited

U.S. PATENT DOCUMENTS

| | | | | |
|---|---|---|---|---|
| 4,634,127 A | | 1/1987 | Rockwell | |
| 4,793,608 A | * | 12/1988 | Mahnke et al. | 482/94 |
| 5,674,167 A | | 10/1997 | Piaget et al. | |
| 5,906,566 A | | 5/1999 | Whitcomb | |

FOREIGN PATENT DOCUMENTS

| | | | | |
|---|---|---|---|---|
| EP | 240087 | * | 4/1986 | 482/99 |
| FR | 2627090 | * | 2/1988 | 482/142 |

OTHER PUBLICATIONS

Tom Purvis, Bowflex Power Pro for all Power PRO Models, Bowflex Fitness Owner's Manual & Fitness Guide, pp. 1–77 (1997).

Tom Purvis, Bowflex Motivator for all Motivator Models, *Strength Training System*, Bowflex Fitness Owner's Manual & Fitness Guide, pp. 1–46 (1997).

Tom Purvis, Bowflex Ultimate, Bowflex Power Pro, Bowflex Fitness Owner's Manual & Fitness Guide, pp. 1–81 (2001).

* cited by examiner

*Primary Examiner*—Jerome Donnelly
(74) *Attorney, Agent, or Firm*—Pillsbury Winthrop LLP

(57) ABSTRACT

An exerciser includes an upright frame assembly constructed and arranged to be disposed in an operative position supported on a horizontal surface. The upright frame assembly has a user support assembly to support a user thereon. First, second and third moving assemblies are disposed in normal inoperative positions with respect to the user support assembly. The first, second and third moving assemblies are manually engaged and individually manually moved away from the normal inoperative position thereof into a desired extended position by a user supported on the user support assembly. First, second and third connecting terminals are connected to the first, second and third moving assemblies, respectively, so that the first and third connecting terminals and the second and third connecting terminals move away from one another when any one of the moving assemblies is moved away from the normal inoperative position thereof. The set of resilient resistance structures has operative extents and is separately connected between the first and third connecting terminals and between the second and third connecting terminals. The set of resilient resistance structures provide resilient resistance throughout the operative extent thereof to the relative movement of the first and third connecting terminals and the second and third connecting terminals away from one another and a resilient bias throughout the operative extent thereof to move the first and third connecting terminals and second and third connecting terminals toward one another.

35 Claims, 14 Drawing Sheets

EXERCISER WITH MULTIPLE BUNGEE CORD RESISTANCE AND ENHANCED BENCH MOVEMENTS

FIELD OF THE INVENTION

This invention relates generally to exercisers and more specifically to exercisers with multiple bungee cord resistance and enhanced bench movements that enable a user to perform various different exercises.

BACKGROUND AND SUMMARY OF THE INVENTION

Recent years have seen an increasing awareness of the benefits of physical exercise and widespread use of exercisers. The therapeutic value of progressive resistance exercises has long been recognized. Exercising muscles against progressively increasing resistance not only results in added strength and endurance in the muscles, but also in a more efficient functioning of the cardiovascular and respiratory systems.

Nowadays, various types of exercisers have been suggested which use elastomeric members such as resistance bands to provide non-gravity resistance to the performance of the exercises.

One such exerciser is described in U.S. Pat. No. 5,674,167 issued to Piaget et al. The exerciser taught by Piaget et al. includes a first plurality of resistance cords for providing resistance to pivotal movement of first and second arm members and a second plurality of resistance cords for providing resistance to a leg member. Each plurality of resistance cords are releasably secured to a fixed anchor such that the first plurality of resistance cords provides resistance to the arm members independently from the resistance provided by the second plurality of resistance cords to the leg member. A user may exercise his/her arms and legs without complex maneuvering or adjustments to the exercise machine as taught by Piaget et al. However, varying the resistance by using elastomeric resistance as taught by Piaget et al. involves adding or subtracting individual resistance cords to the apparatus, which can be both burdensome and time consuming. Further, since the resistance cords are typically separate units, they can be lost or misplaced, increasing costs for replacement, and frequently are strewn about the apparatus in a manner to create substantial tripping hazards.

Consequently, there exists a need in the art to provide an exerciser which is cost-effective, convenient for transportation, versatile, and capable of providing variable resistance without removing components thereof.

To achieve this need, the present invention can be applied to U.S. patent application Ser. No. 09/737,548 filed concurrently herewith and hereby incorporated by reference in its entirety. That object is achieved by providing an exerciser which features a frame assembly including a lower frame portion that is constructed and arranged to be stablely supported in an operative position on a horizontal surface. First and second rigid upright support members is fixed at lower end portions thereof on the lower frame portion and extends upwardly from the lower frame portion when in the operative position thereof. A user support assembly is operatively connected with the lower frame portion. The user support assembly is constructed and arranged to support a user thereon.

The pair of rigid upright support members has first and second rigid upper free end portions respectively configured to curve upwardly from the lower portions thereof in outwardly diverging relation with respect to one another. First and second moving assemblies is disposed in normal inoperative positions with respect to the user support assembly. Each moving assembly is constructed and arranged to be manually engaged and individually manually moved away from the normal inoperative position thereof into a desired extended position by a user supported on the user support assembly.

The first and second moving assemblies comprise first and second upper pulley members rotatably mounted on the upper free end portions of the first and second rigid upright support members, respectively. First and second lower pulley members are rotatably mounted on the frame assembly at fixed positions below the first and second upper pulley members and first and second flexible elongated structures are trained around the first and second lower pulley members, respectively. The first and second flexible elongated structures extend upwardly over the first and second upper pulley members respectively and then downwardly toward the lower frame portion.

Movement preventing structures on the lower frame portion are operatively associated with terminal portions of the first and second flexible elongated structures and extend downwardly from the first and second upper pulley members. The movement preventing structures are constructed and arranged to prevent upward movements of the terminal portions. First and second user hand grip units is connected with first and second end portions of the first and second flexible elongated structures. The first and second user hand grip units extend outwardly from the lower pulley members in positions to enable a user supported on the user support assembly to move the user hand grip units away from inoperative positions thereof into desired extended positions.

The first and second flexible elongated structures include first and second bungee cords constructed and arranged to resiliently resist movement of the user hand grip units and the end portions of the flexible elongated structures away from the inoperative positions thereof into desired extended positions. The first and second bungee cords are further constructed and arranged to resiliently return the user hand grip units to the inoperative positions thereof when no longer moved by the user.

Another such exerciser is described in U.S. Pat. No. 5,906,566 issued to Whitcomb. The exerciser taught by Whitcomb includes a single plurality of resistance elements for either providing resistance to handle grips or to a leg unit which are connected to opposite ends of the resistance elements. Whitcomb provides an exercise machine having a single plurality of resistance elements, which are not removed from the exercise machine during normal usage, thus eliminating the risks and cost described above with respect to loose resistance elements. Even though the exercise machine is relatively versatile, it includes numerous pivotally movable components, which can be relatively bulky and can require many steps to maneuver the exercise machine into various positions for effecting the different modes of exercise. These extra steps require extra time to move the exercise machine between different positions and can significantly lengthen the workout. Thus, the ability to maneuver the exerciser into various positions for effecting the different modes of exercise quickly is greatly desirable to help reduce unnecessary time between exercises.

While the cited prior art exercisers are effective for their intended purpose, there is always a continuing need for new and improved exercisers which are cost-effective, convenient for transportation and storage, versatile, capable of providing variable resistance and relatively easy to maneuver between various positions for effecting different modes of exercise.

To achieve this need, an exerciser comprising an upright frame assembly, first and second moving assemblies, a third moving assembly, first, second and third connecting terminals and a set of resilient resistance structures is provided. The upright frame assembly is constructed and arranged to be disposed in an operative position supported on a horizontal surface. The upright frame assembly has a user support assembly constructed and arranged to support a user thereon.

The first and second moving assemblies are disposed in normal inoperative positions with respect to the user support assembly and are constructed and arranged to be manually engaged and individually manually moved away from the normal inoperative position thereof into a desired extended position by a user supported on the user support assembly.

The third moving assembly is disposed in a normal inoperative position with respect to the user support assembly. The third moving assembly is constructed and arranged to be engaged and moved away from the normal inoperative position thereof into a desired extended position by a user supported on the user support assembly.

The first, second and third connecting terminals are connected to the first, second and third moving assemblies, respectively, so that the first and third connecting terminals and the second and third connecting terminals move away from one another when any one of the moving assemblies is moved away from the normal inoperative position thereof.

The set of resilient resistance structures has operative extents and is constructed and arranged to be separately connected between the first and third connecting terminals and between the second and third connecting terminals. The set of resilient resistance structures provide resilient resistance throughout the operative extent thereof to the relative movement of the first and third connecting terminals and the second and third connecting terminals away from one another and a resilient bias throughout the operative extent thereof to move the first and third connecting terminals and second and third connecting terminals toward one another.

The resilient resistance structures are related to the upright frame assembly such that the first and third connecting terminals and the second and third connecting terminals are restrained against biased movement toward one another beyond normal inoperative positions thereof corresponding generally with the normal inoperative positions of the moving assemblies. The resilient resistance structures permit the first and third connecting terminals and the second and third connecting terminals to move relatively away from one another so that (1) manual movement of the first moving assembly away from the inoperative position thereof causes the first connecting terminal to move away from the third connecting terminal enabling the resilient structure connected thereto to provide resilient resistance throughout the operative extent thereof to the movement of the first moving assembly away from the inoperative position thereof, (2) manual movement of the second moving assembly away from the inoperative position thereof causes the second connecting terminal to move away from the third connecting terminal enabling the resilient structure to provide resilient resistance throughout the operative extent thereof to the movement of the second moving assembly away from the inoperative position thereof, and (3) movement of the third moving assembly away from the inoperative position thereof causes the third connecting terminal to move away from the first and second connecting terminals enabling the set of resilient structures connected thereto to provide resilient resistance throughout the operative extent thereof to the movement of the third moving assembly away from the inoperative position thereof.

Generally, exercisers of this type have been known to provide a user support assembly or bench for supporting users while they effect various different modes of exercise. Numerous exercisers that incorporate benches for providing support to users have heretofore been known in the art.

Some exercisers incorporate benches such as a split bench having a seat back and a seat member hingeably connected so that the bench can be adjusted for use in connection with both a flat bench position and a sitting position. Snyderman et al U.S. Pat. No. 5,069,447 represents an example of one such exerciser.

Other exercisers, especially those configured to provide multiple exercises or a bench which may be maneuvered between various positions may be cumbersome to transport and may take up a large area. One such exerciser, such as Rockwell U.S. Pat. No. 4,634,127, includes a bench assembly which may be moved into a storage position. The exercise machines taught by Piaget et al. and Whitcomb may also be moved into a storage position, but both exercise machines require a relatively complex series of movements and adjustments before being moved into the storage positions thereof.

Consequently, there exists a need in the art to provide an exerciser that is cost-effective, convenient for transportation and storage, versatile, and relatively easy to maneuver between various positions for effecting different modes of exercise.

Another aspect of the present invention is to provide an exerciser comprising an upright frame assembly. The upright frame assembly is constructed and arranged to be disposed in an operative position supported on a horizontal surface. The upright frame assembly has a user support assembly constructed and arranged to support a user thereon. Exercising assemblies on the upright frame assembly are constructed and arranged to be moved through exercising strokes by a user supported on the user support assembly.

The user support assembly includes a user seat member, a user seat back member, and an elongated support member having one end connected to the upright frame assembly and extending in an operative position generally horizontally outwardly therefrom. An outer leg structure is constructed and arranged to engage and be supported on the horizontal surface in spaced relation to the frame. The outer leg structure extends in an operative position in supporting relation with respect to the elongated support member to maintain the elongated support member in the generally horizontally outwardly extending relation from the lower frame portion. Seat mounting structure mounts the user seat member with respect to the elongated support member and the leg structure is moved horizontally with respect to the elongated support member when in the operative position thereof between an outer position and an inner position and spaced inwardly of and at generally the same level as the outer position. A seat back mounting structure is operatively associated with the seat back member. The seat back member is constructed and arranged to enable said seat back member to be selectively retained in a bench position extending in generally horizontally aligned relation to the user seat member in an outer position thereof and an upright position extending generally inwardly in inclined relation to the user seat member in an inner position thereof.

Another aspect of the present invention is achieved by the elongated support member being pivotally mounted at the one end to the upright frame assembly so as to be moved between the operative position thereof and an upright storage position wherein the elongated support member, the outer leg structure and the seat and seat back members are alongside the upright frame assembly.

Other objects, features, and advantages of the present invention will become apparent from the following detailed description, the accompanying drawings, and the appended claims.

DETAILED DESCRIPTION OF THE INVENTION

Figure 1:
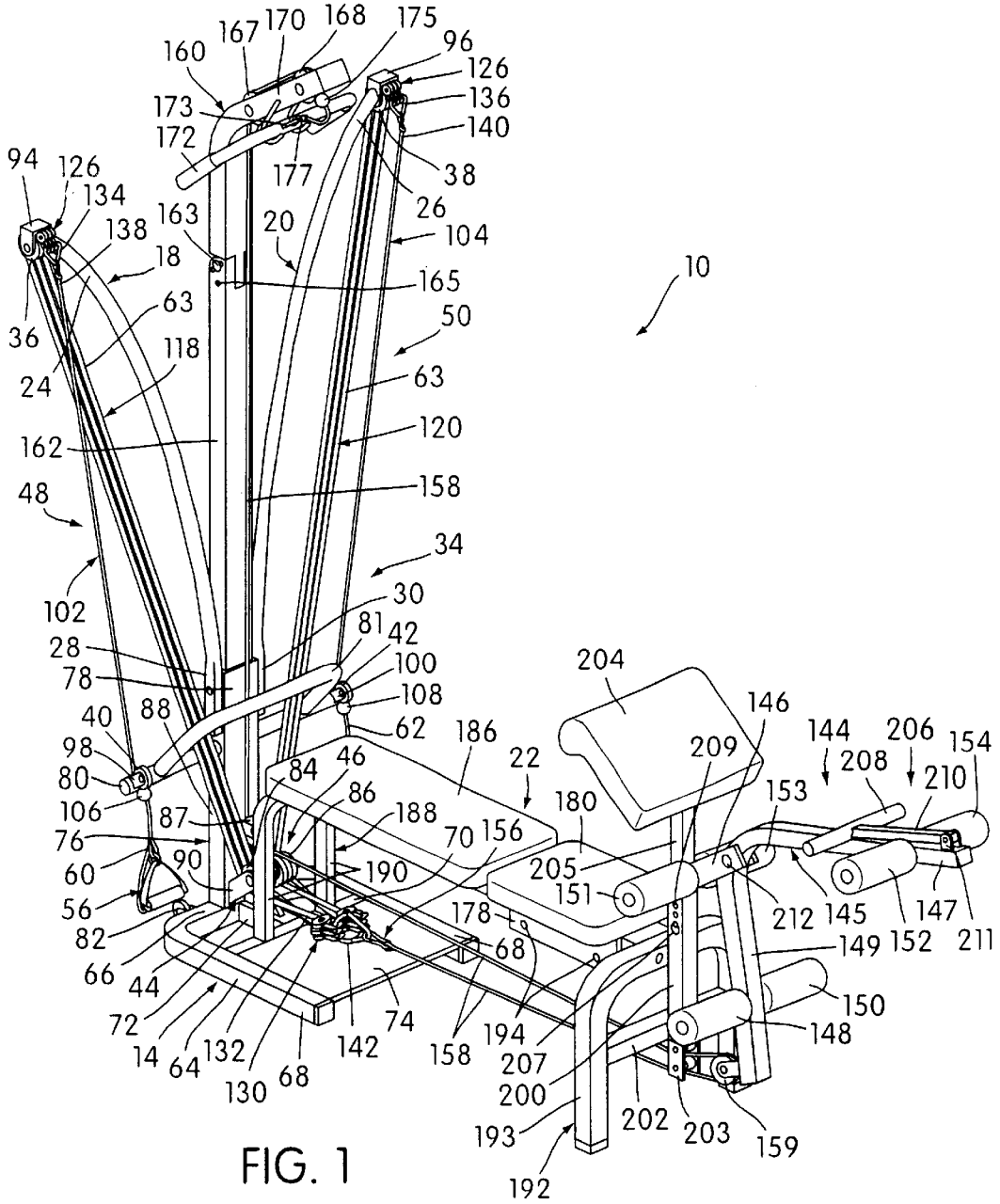
FIG. 1 is a perspective view of an exerciser embodying the principles of the present invention shown in an inline bench position.
Figure 2:
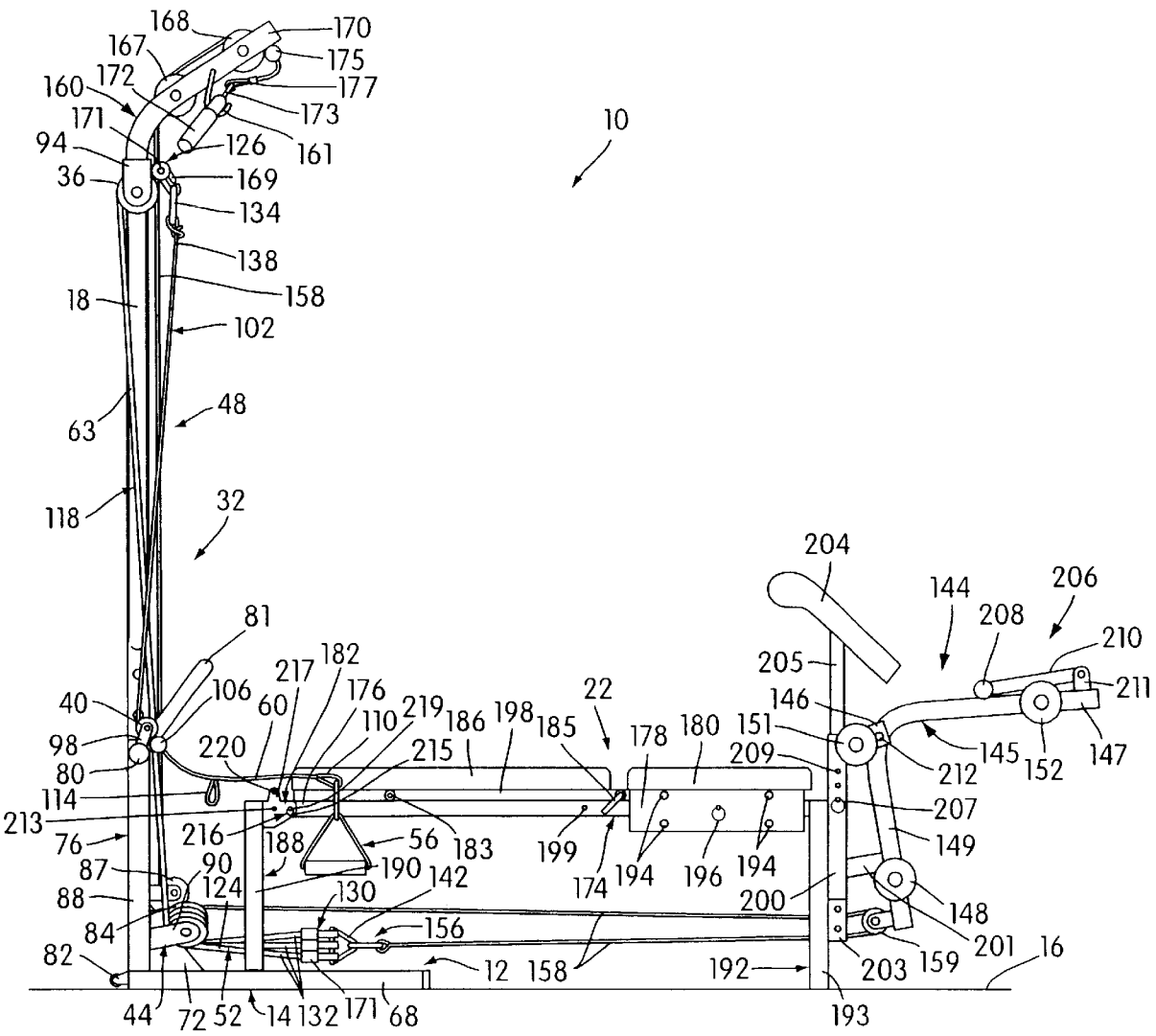
FIG. 2 is a side view of the exerciser of FIG. 1 showing the leg-engaging unit in a normal inoperative position thereof and the user support assembly in the inline bench or outer position thereof.
Figure 3:
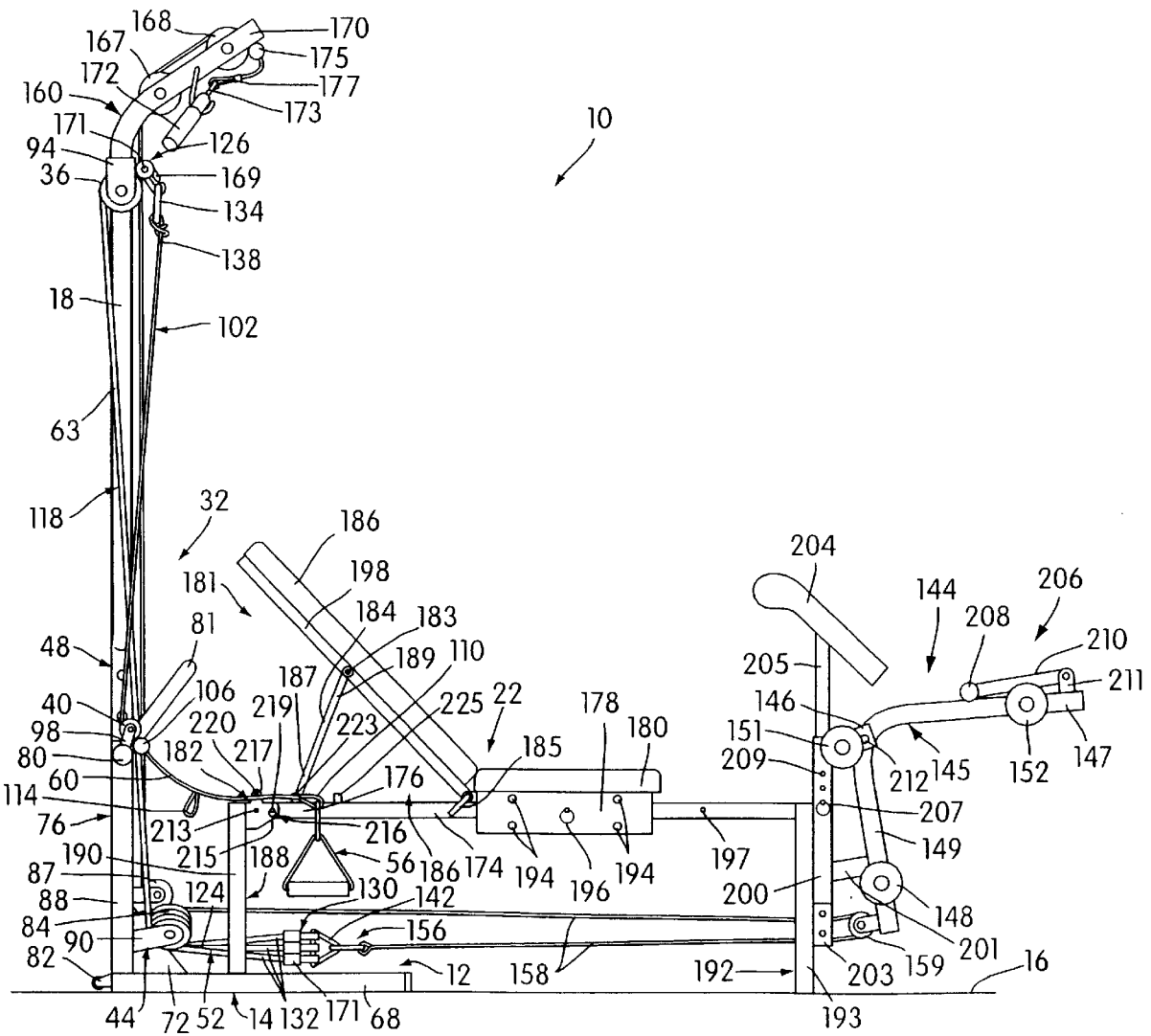
FIG. 3 is a side view of the exerciser of FIG. 1 showing the leg-engaging unit connected to the exerciser in a normal inoperative position thereof and the user support assembly in the upright or inner position thereof.

Referring now more particularly to the drawings, FIGS. 1–3 illustrate an exerciser, generally indicated at 10, embodying the principles of the present invention. The exerciser 10 comprises a frame assembly, generally indicated at 12, having bungee cords 63 mounted thereto to provide resilient resistance to first and second moving assemblies, generally indicated at 32, 34, respectively, a leg-engaging unit, generally indicated at 144, and a hand grip bar assembly, generally indicated at 160. The exerciser 10 further comprises a user support assembly, generally indicated at 22, movable between an inner and outer position thereof by seat back mounting structure.

The frame assembly 12 includes a lower frame portion, generally indicated at 14, constructed and arranged to be stablely supported in an operative position on a horizontal surface 16 and the user support assembly 22 is operatively connected with the lower frame portion 14 to support a user thereon.

First and second rigid upright support members 18, 20 are fixed at lower end portions 28, 30 thereof on the lower frame portion 14 and extend upwardly from the lower frame portion 14 when in the operative position thereof. The first and second rigid upright support members 18, 20 have first and second rigid upper free end portions 24, 26, respectively. The upper free end portions 24, 26 are configured to curve upwardly from the lower portions 28, 30 thereof in outwardly diverging relation with respect to one another.

A pair of separate moving assemblies 32, 34 is disposed in normal inoperative positions with respect to the user support assembly 22. Each moving assembly 32, 34 is constructed and arranged to be manually engaged and individually manually moved away from the normal inoperative position thereof into a desired extended position by a user supported on the user support assembly 22.

The first and second moving assemblies 32, 34 include first and second upper pulley members 36, 38 rotatably mounted on the upper free end portions 24, 26 of the first and second rigid upright support members 18, 20, respectively. First and second lower pulley members 40, 42 are rotatably mounted on the frame assembly 12 at fixed positions below the upper pulley members 36, 38, respectively. First and second flexible elongated structures, generally indicated at 48, 50, are trained around the lower pulley members 40, 42 and extend upwardly over the first and second upper pulley members 36, 38 respectively. Terminal end portions 52, 54 of the first and second flexible elongated structures 48, 50 extend downwardly from the upper pulley members 36, 38 toward the lower frame portion 14.

Movement preventing structures, generally indicated at 44, 46, on the lower frame portion 14 are operatively associated with the terminal end portions 52, 54 of the first and second flexible elongated structures 48, 50,respectively, (only the movement preventing structure 44 and its operatively associated terminal end portions 52 are seen in FIGS. 1–3). The movement preventing structures 44, 46 are constructed and arranged to prevent upward movements of the terminal end portions 52, 54.

First and second user hand grip units 56, 58 are connected with first and second end portions 60, 62 of the first and second flexible elongated structures 48, 50, respectively. The end portions 60, 62 are at opposite ends of the first and second flexible elongated structures 48, 50 as the terminal end portions 52, 54. The end portions 60, 62 extend outwardly from the lower pulley members 40, 42 in positions to enable a user supported on the user support assembly 22 to move the user hand grip units 56, 58 away from inoperative positions thereof into desired extended positions.

The first and second flexible elongated structures 48, 50 include bungee cords 63, which constitute resilient resistance structures, at the terminal end portions 52, 54 thereof. The bungee cords 63 resiliently resist movement of the user hand grip units 56, 58 and the end portions 60, 62 of the flexible elongated structures 48, 50 away from the inoperative positions thereof into desired extended positions. The bungee cords 63 are further configured to resiliently return the user hand grip units 56, 58 to the inoperative positions thereof when no longer moved by the user.

The lower frame assembly 14 may be formed from a rigid material, such as steel, and includes a substantially symmetrical U-shaped support base 64. The U-shaped support base 64 has a generally straight central section 66 and a pair of spaced legs 68 which extend from the central section 66 to provide support to the lower frame portion 14 of the exerciser 10. A cross member 70 extends between the support legs 68 in parallel spaced relation to the central section 66 and a support bar 72 extends from the mid-portion of the central section 66 toward the cross member 70 in order to provide additional support to the lower frame portion 14. A cover plate 74, which may be made from steel, plastic, wood, such as plywood, or any other type of material, is positioned in abutting relation to the cross member 70 so as to form a common plane therewith which substantially covers the area extending between the spaced legs 68. As best shown in FIG. 1, a mounting support member 76 vertically extends from the central section 66 of the support base 64. The mounting support member 76 has a hollow transverse cross section, preferably substantially rectangular in form so as to provide sufficient strength and support to the lower frame assembly 14 of the exerciser 10. Other exercise components, such as the hand grip bar assembly 160, can be positioned within the mounting support member 76 to provide added versatility to the exerciser 10, as will be further described in detail below.

A pulley mounting member 80 is mounted to an upper portion 78 of the mounting support member 76, such as by transversely extending therethrough, so as to form a cross or t-shape therewith. The pulley mounting member 80 is preferably tubular in form and bonded to the mounting support member 76, for example, by welding, for additional structural rigidity of the lower frame portion 14. It may be preferable to mount the pulley mounting member 80 forwardly or rearwardly of the mounting support member 76.

A protruding member 81 outwardly and upwardly extends from the pulley mounting member 80 such that during certain exercises described below, the user may position his/her feet thereon, e.g. for resting purposes. The protruding member 81 is generally C-shaped and may be adapted to retain the bungee cords 63 within a confined area of lateral movement in cooperation with the pulley mounting member 80.

In the exemplary embodiment, each rigid upright support member 18, 20 is mounted, preferably by fasteners or bonding, such as welding, at respective lower portions 28, 30 thereof to the mounting support member 76. The rigid upright support members 18, 20 may be positioned on opposite sides of the mounting support member 76 and slightly above the pulley mounting member 80 such that the lower end portions 28, 30 thereof abut the upper portion 78 of the mounting support member 76.

A guide pulley member 87 may be rotatably mounted on a lower portion 88 of the mounting support member 76 to extend outwardly therefrom. The guide pulley member 87 is configured to guide an elongated flexible non-extensible element 158 extending from the hand grip bar assembly 160, as will be described in greater detail below.

A pair of horizontally spaced rollers 82 might be rotatably mounted on the generally straight central section 66 of the lower frame 14 for rotation about a horizontal axis parallel to the central section 66. The rollers 82 are positioned to facilitate the transport of the exerciser 10 to different locations of use, as will be described in further detail below.

The movement preventing structures 44, 46 include a series of lower pulley members 84, 86. Each lower pulley member 84, 86 is rotatably mounted on the lower portion 88 of the mounting support member 76 by a lower bungee cord stop structure 90, 92, respectively. The lower bungee cord stop structures 90, 92 extend across a peripheral portion of the associated lower pulleys 84, 86. The movement preventing structure 46 and the lower bungee cord stop structure 92 are not visible in FIG. 1, however, these elements are represented by the movement preventing structure 44 and the lower bungee cord stop structure 90, respectively, shown in FIG. 1.

Alternatively, in an embodiment not shown, the first and second elongated structures 48, 50 could be fixed at the terminal ends 52, 54 thereof to the mounting support member 76 to prevent upward movements of the terminal portions 52, 54. For example, the lower pulleys 84, 86 and stop structures 90, 92 may be removed from the mounting support member 76 by securing the terminal portions 52, 54 of each elongated structure 48, 50, respectively to the mounting support member 76.

FIG. 1 best illustrates the first and second upper pulley members 36, 38 having an upper stop structure 94, 96, respectively, which extends across a peripheral portion thereof. The upper stop structures 94, 96 rotatably mount the first and second upper pulley members 36, 38, respectively on the upper free end portions 24, 26 of the first and second rigid upright support members 18, 20.

As illustrated, a pair of lower stop structures 98, 100 diagonally extends upwardly and outwardly from the pulley mounting member 80. The lower stop structures 98, 100 rotatably mount the lower pulley members 40, 42 in horizontally spaced relation on the pulley mounting member 80 such that the lower stop structures 98, 100 extend across a peripheral portion of the lower pulley members 40, 42, respectively.

The first and second flexible elongated structures 48, 50 further include first and second flexible elongated non-extensible elements 102, 104, such as, for example, nylon cords or other flexible elongated non-extensible elements. The first and second flexible elongated non-extensible elements 102, 104 are trained around the lower pulley members 40, 42 so as to provide the first and second outwardly extending end portions 60, 62, respectively, of the first and second flexible elongated structures 48, 50.

Each non-extensible element 102, 104 has a stop element 106, 108, respectively, fixed to the respective end portion 60, 62 thereof. Each non-extensible element 102, 104 interengages with the respective lower stop structure 98, 100 to determine the inoperative position of the first and second moving assemblies 32, 34, respectively. More specifically, the stop elements 106, 108 cooperate with the stop structure 98,. 100 of the respective lower pulley members 40, 42 to determine the inoperative positions of the end portions 60, 62 of the non-extensible elements 102, 104.

The end portions 60, 62 of the non-extensible elements 102, 104 have respective looped end portions 110, 112. The looped end portions 110, 112 are configured to connect with the first and second hand grip units 56, 58, respectively. The stop elements 106, 108 are fixed on the non-extensible elements 102, 104 in spaced relation to the looped end portions 110, 112 thereof. Looped intermediate portions 114, 116 are disposed between the associated stop elements 106, 108 and the respective looped end portions 110, 112 of the non-extensible elements 102, 104. The looped intermediate portions 114, 116 are configured to selectively receive the first and second hand grip units 56, 58, respectively, in connecting relation thereto.

Figure 4:
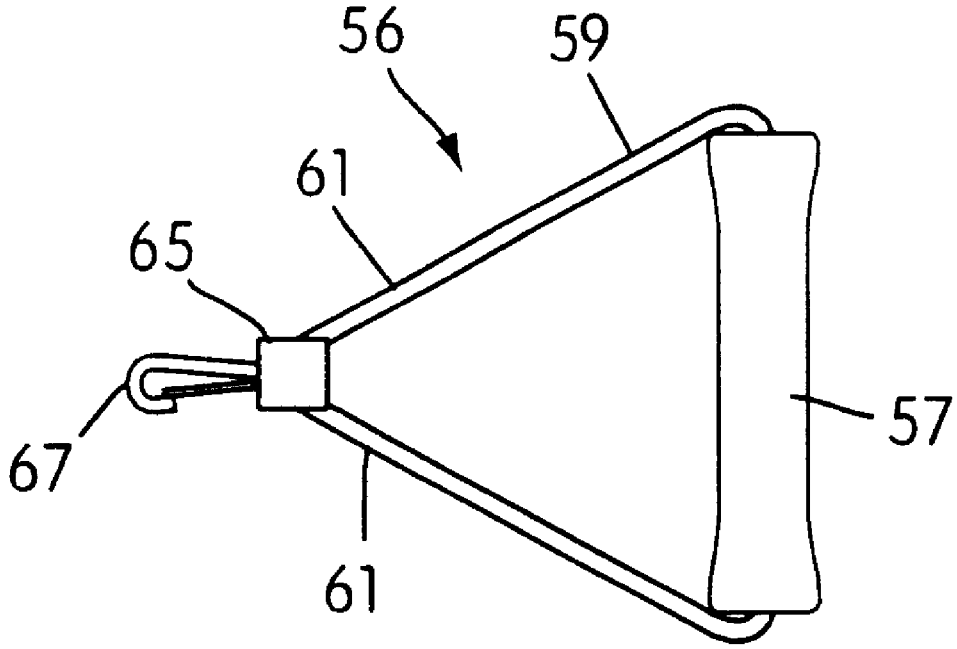
FIG. 4 is a side view of a hand grip unit of FIG. 1.

FIG. 4 illustrates the hand grip unit 56. The hand grip units 56, 58 are the same in construction and the description of the hand grip unit 56 will suffice for both. As best shown in FIG. 4, each hand grip unit 56, 58 includes a tubular gripping member 57 which is manually engageable by the user during various exercises. A flexible strap 59, such as nylon or cable, extends through the gripping member 57 to provide free ends 61. A binding member 65 binds the free ends 61 together and secures the gripping member 57 between the free ends 61.

A latching or securing member 67 is releasably secured to the binding member 65 at one end thereof in a position which facilitates the other end thereof to latch onto the first and second moving assemblies 32, 34, respectively, through the looped portions 110, 112, 114, or 116. When the latching member 67 is latched onto one of the first and second moving assemblies 32, 34, a force exerted on the gripping member 57 by the user moves the respective moving assembly 32, 34 on which the gripping member 57 is attached.

It may be preferable to store the hand grip units 56, 58, when not in use, by connecting the latching member 67 through both looped portions 110, 114 or 112, 116 of the non-extensible elements 102, 104, respectively (as illustrated in FIG. 1).

Alternatively, the hand grip units 56, 58 may include the tubular gripping member 57 and any known flexible or rigid member for securing the latching member 67 thereto. The latching member 67 may be of any known configuration.

In the exemplary embodiment, the bungee cords 63 are grouped into a first and second series of resiliently extensible bungee cords 118, 120 associated with the first and second moving assemblies 32, 34, respectively. Each series of bungee cords 118, 120 may include three bungee cords 63, each providing a resilient resistance.

In an exemplary embodiment, each series of bungee cords 118, 120 includes one bungee cord 63 that provides ten pounds of resistance and two bungee cords 63 that each provide twenty pounds of resistance. However, any number of bungee cords 63 may be used in each series 118, 120 and the bungee cords 63 can have equal or different resilient resistances so as to provide the desired resilient resistance.

Each bungee cord 63 in the first and second series 118, 120 has an upper end portion 122 trained around one of the upper pulley members 36, 38 and a lower end portion 124 trained about one of the lower pulleys 44, 46, respectively.

Figure 5:
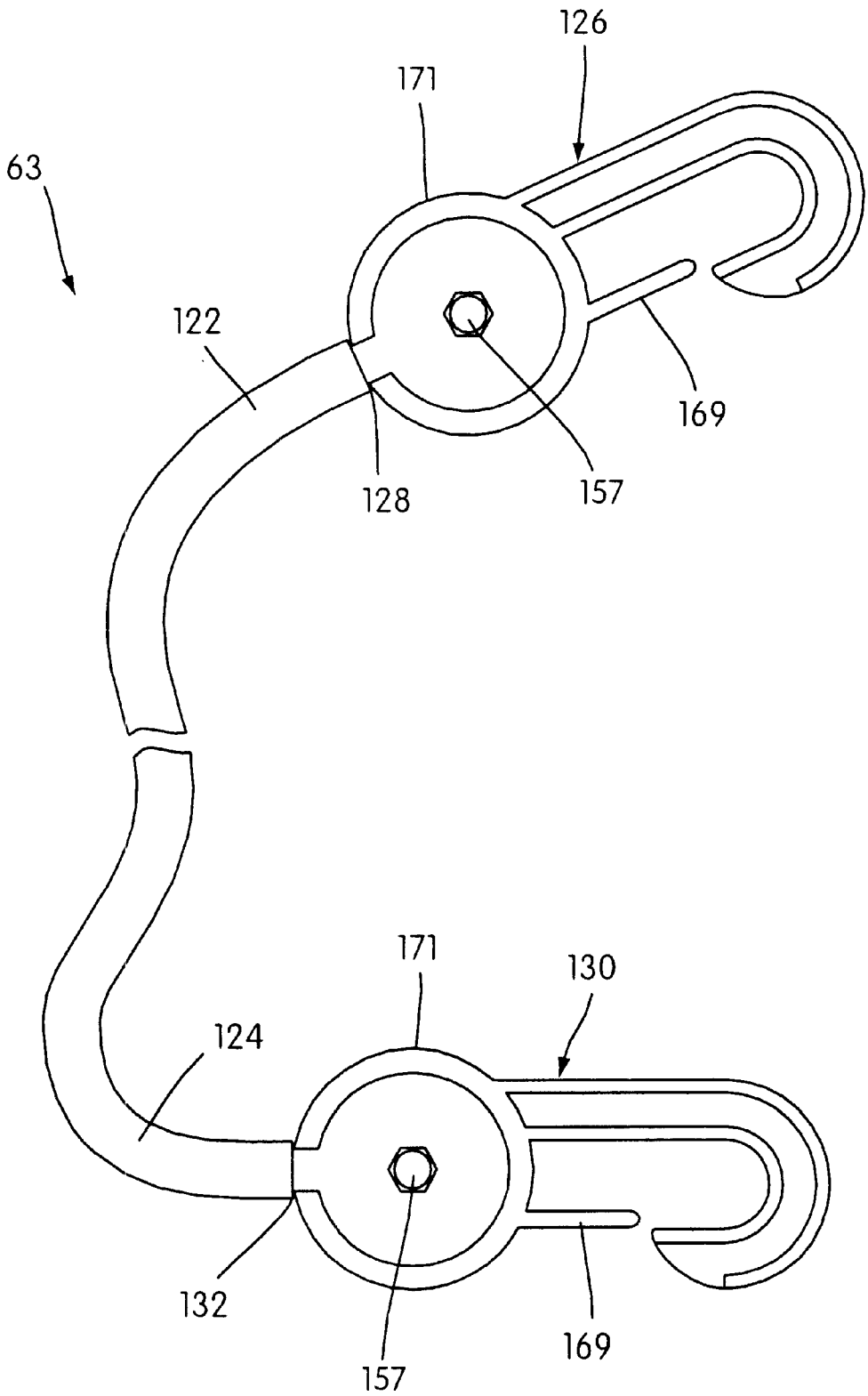
FIG. 5 is a side view of a bungee cord of FIG. 1.

As best shown in FIG. 5, an upper hook connector 126 is fixed on each terminal end 128 of the bungee cords 63 and a lower hook connector 130 is fixed on each terminal end 132 of the bungee cords 63. The upper hook connectors 126 selectively engage with first and second connecting terminals 134, 136, respectively, so that the first and second connecting terminals 134, 136 move substantially in the same direction when the respective moving assemblies 32, 34 are moved away from the normal inoperative position thereof.

The connecting terminals 134, 136 are fixedly disposed on adjacent ends 138, 140 of the associated non-extensible element 102, 104 to provide resilient resistance thereto. For example, the adjacent ends 138, 140 of the non-extensible elements 102, 104 may be fixedly disposed on the connecting terminals 134, 136 by a hook connector or by tying the ends 138, 140 around the respective connecting terminal 134, 136. The connecting terminals 134, 136 are disposed in close proximity to the associated upper stop structure 94, 96 when the moving assemblies 32, 34 are in an inoperative position thereof. The lower hook connector 130 selectively engages a third connecting terminal 142, which is connected with the leg-engaging unit 144 to provide resilient resistance thereto, as will be described in further detail below. The lower hook connectors 130 may be configured to have an enlarged portion 171, which might selectively engage the associated lower bungee cord stop structure 90, 92 when the moving assemblies 32, 34 are in an inoperative position thereof.

It is contemplated that the leg-engaging unit 144, the hand grip bar assembly 160, or the combination thereof may constitute the third moving assembly.

The number of hook connectors 126, 130 connected to each connecting terminal 134, 136, 142 determines the number of bungee cords 63 resisting movement of the corresponding moving assembly 32, 34, 144 away from the inoperative position thereof. In the exemplary embodiment, each bungee cord 63 provides a resilient resistance and the total resistance provided with respect to any moving assembly 32, 34, 144 can be varied by virtue of a selection of any one, any two or all three bungee cord hook connectors 126, 130, respectively to be connected to the associated connecting terminal 134, 136, 142.

It may be preferable for the connecting terminals 134, 136, 142 to be constructed in the form of rigid annular members, such as metal rings, but the connecting terminals 134, 136, 142 could be formed into any rigid or flexible configuration capable of being engaged by the hook elements 126, 130. For example, as shown in FIGS. 1–4 and 7–13, the third connecting member 142 is formed into a hook up bracket having three separate connecting portions thereof, two of which being engaged by the hook elements 126, 130 and one of which being engaged by the connector 156.

As illustrated in FIGS. 2–4, 7 and 8, the leg-engaging unit 144 is disposed in a normal inoperative position with respect to the user support assembly 22. The leg-engaging unit 144 includes an L-shaped member 145 that is pivotally attached to an outer end portion 146 of the user support assembly 22. The L-shaped member 145 is engaged to be moved away from the normal inoperative position thereof into a desired extended position by a user supported on the user support assembly 22, as will be described in greater detail below.

The L-shaped member 145 includes a generally straight portion 147 and a downwardly angled portion 149. A pair of horizontally aligned and fixedly spaced leg-engaging members 148, 150 is pivotally mounted to the angled portion 149 of the L-shaped member 145. The leg-engaging members 148, 150 are pivotally movable with the angled portion 149 from a normal inoperative position disposed outwardly of the user support assembly 22. Another pair of horizontally aligned and fixedly spaced leg-engaging members 151, 153 are mounted to the angled portion 149 above the other pair of leg-engaging members 148, 150 in vertically spaced relation with respect thereto.

A pair of leg curl members 152, 154 are mounted to the generally straight portion 147 outwardly of the outer end portion 146 so as to engage a user's legs during leg curl exercises. The leg curl members 152, 154 are positioned in a normal inoperative position spaced upwardly and outwardly from the inoperative position of the leg-engaging members 148,150 and move with the leg-engaging unit 144.

In the exemplary embodiment, a pulley member 159 is rotatably mounted to the angled portion 149 of the L-shaped member 145. An elongated flexible non-extensible element 158 has one end connected to a selectively connectable and disconnectable connector 156, which is selectively connected to the third connecting terminal 142. The elongated flexible non-extensible element 158 extends away from the third connecting terminal 142 toward the leg-engaging unit 144. The elongated flexible non-extensible element 158 abuts a pair of rollers 203, i.e., the lower roller of the pair, and is trained around the pulley member 159. The elongated flexible non-extensible element 158 extends from the pulley member 159 through the pair of rollers 203, i.e., between the upper and lower rollers, to the guide pulley member 87. The elongated flexible non-extensible element 158 is trained around the guide pulley member 87 and extends upwardly along the centrally located upright frame member 162 toward the hand grip bar assembly 160.

The bungee cords 63, which constitute the terminal end 52, 54 of the first and second flexible elongated structures 48, 50, are connected to the third connecting terminal 142 in opposing relation to the connector 156 by the lower hook connectors 130.

The elongated flexible non-extensible element 158 facilitates the first and third connecting terminals 134, 142 and the second and third connecting terminals 136, 142 to move away from one another when one of the moving assemblies 32, 34, 144 is moved away from the normal inoperative position thereof.

As best shown in FIGS. 1 and 7–14, the hand grip bar assembly 160 is mounted to extend upwardly from the mounting support member 76. A centrally located upright rigid frame member 162 is disposed within the interior of the mounting support member 76 and is fixedly secured therein by welding or any known manner such as, for example screws, nuts and bolts, friction fit, interference fit or any fastener arrangement known in the art.

Alternatively, the fastener arrangement may include a pin and opening arrangement whereby the pin is removable received through a pair of horizontally aligned openings (not shown) extending through the mounting support member 76 and the frame member 162. That way, the fastener could allow optional removable attachment of the frame member 162 of the hand grip assembly bar 160.

The hand grip bar assembly 160 is carried by the central upright rigid frame member 162 in a normal inoperative position with respect to the user support assembly 22. An upper inclined end 170 of the hand grip bar assembly 160 may be pivoted away from the leg-engaging unit 144 with respect to the central upright rigid frame member 162 via a pivot pin 165. The upper inclined end 170 may be retained in either the upright position (FIG. 1) or the pivoted position (FIG. 14) by a pin and opening arrangement. Alternatively, the central upright rigid frame member 162 may be configured to stop pivotal movement of the upper inclined end 170 away from the leg-engaging unit 144.

The pin and opening arrangement may include a pin 163, which is removably received through a pair of vertically spaced aligned openings (not shown) extending through the central upright rigid frame member 162. The pin 163 may be removably received through any two of the aligned openings to allow pivotal adjustment of the upper portion 170 for accommodating the leg-engaging unit 144 when the exerciser is moved into the storage position thereof, as will be further described below. The pin 163 may be removed from the openings to allow the upper inclined end 170 to pivot away from the leg-engaging unit 144.

The elongated flexible non-extensible element 158 extends upwardly from the guide pulley member 87 along the centrally located upright frame member 162 and over two upper pulleys 167, 168. The two upper pulleys 167, 168 are rotatably mounted on the upper inclined end 170 of the centrally located upright frame member 162.

A manually engageable hand grip bar 172 defines an opening 173 in a mid-portion thereof. The hand grip bar 172 is latched to a conventional latching mechanism 177 that is disposed on the end of the elongated flexible non-extensible element 158. The elongated flexible non-extensible element 158 and latching mechanism 177 extends from both upper pulleys 167, 168, and latches the hand grip bar 172 through the opening 173 therein.

In the exemplary embodiment, the hand grip bar 172 may be engaged by a user and moved away from the normal inoperative position of the hand grip bar assembly 160 into a desired extended position thereof by a user supported on the user support assembly 22.

The upper inclined end 170 may include a pair of J-shaped supporting elements 161, which are rigidly mounted to opposite sides thereof. The J-shaped supporting elements 161 are configured to receive and retain the hand grip bar 172 therebetween to stabilize and preclude swinging thereof when not being used. Alternatively, the J-shaped supporting elements 161 may be pivotally mounted to opposite sides of the upper inclined end 170.

An annular stop element 175 is disposed between the latching mechanism 177 and the upper inclined end 170. The upper inclined end 170 together with the uppermost pulley member 168 precludes the stop element 175 and the elongated flexible non-extensible element 158 from moving due to the resilient bias exerted by the bungee cords 63.

In the exemplary embodiment, the connector 156 is connected to the connecting terminal 142 so as to render the leg-engaging unit 144 and the hand grip bar assembly 160 to have the movement thereof away from the inoperative position thereof resisted by the bungee cords 63. That way, the bungee cords 63 may provide resistance to the movement of the leg-engaging unit 144 and the hand grip bar assembly 160 without disconnecting or connecting the connector 156.

FIG. 5 illustrates a bungee cord 63 having the hook connectors 126, 130 disposed on opposite terminal ends 128,132 thereof. The hook connectors 126, 130 are of the same construction and operation as one another. Each hook connector 126, 130 includes a flexible movable element 169 extending from the enlarged annular portion 171. The flexible movable elements 169 are preferably made from plastic so as to allow easy passage of the respective connecting terminal 134, 136, 142 therethrough. That way, each hook connector 126, 130 may be quickly connected to and quickly disconnected from the respective connecting terminal 134, 136, 142.

The annular portions 171 of the hook connectors 126, 130 are constructed to engage the respective upper stop structures 94, 96 and the stop structures 90, 92, respectively, when the first and second moving assemblies 32, 34 are moved into the normal inoperative positions thereof.

Extending through each hook connector 126, 130 is a conventional fastener 157, which fixedly secures each bungee cord 63 thereto. The fastener 157 secures the bungee cords 63 to the annular portions 171 so that forces exerted on the bungee cords 63 can be transmitted through the respective hook connector 126, 130 without the bungee cords 63 becoming unattached from the annular portions 171.

The hook connectors 126, 130 may be molded from a plastic material, however, it is contemplated that the hook connectors 126, 130 may be constructed in any known manner. The hook connectors 126, 130 may be of any known material capable of providing sufficient strength or rigidity that may easily connect and disconnect from the connecting terminals 134, 136, 142.

As best shown in FIGS. 1–3, the user support assembly 22 includes an elongated support member 174. The elongated support member 174 has one end 176 connected to a U shaped frame support member 188, with the opened portion of the U configuration facing downwardly toward the cross member 70. Spaced ends 190 of the support member 188 are integrally attached to cross member 70 in substantially perpendicular relation thereto. The elongated support member 174 extends in an operative position generally horizontally outwardly from a pivoted frame bracket member 182 extending from the support member 188. The elongated support member 174 is pivotally attached to the support member 188 by a pivot pin 213, which horizontally extends through both the elongated support member 174 and the pivoted frame bracket member 182.

In the illustrated embodiment, the pivoted frame bracket member 182 provides a projecting flange 215, which projects outwardly from the pivoted frame bracket member 182 toward the leg-engaging unit 144, and an upwardly extending flange 217. The projecting flange 215 and the upwardly extending flange 217 define a pair of centrally disposed fastener-receiving holes 219, 220, respectively, therein. The fastener-receiving holes 219, 220 can align with fastener-receiving holes (not shown) in the elongated support member 174 for removably receiving a removable fastener or pin 216 therethrough, as will be described in greater detail below.

A slide frame unit 178 supports a user seat member 180 in slidable relation with respect to the elongated support member 174 to be moved horizontally with respect thereto. The user seat member 180 is slidably mounted on the elongated support member 174 to be moved into operative position thereof between an outer position and an inner position. The inner position of the user seat member 180 is spaced inwardly of and at generally the same level as the outer position.

In the exemplary embodiment, a pivoted strut frame 184 and a pivoted support frame unit 181 are disposed in supporting relation to a seat back member 186. The seat back member 186 is pivotally connected to the slide frame unit 178 by the pivoted support frame unit 181. A removable cylindrical shaft member 185 extends through and is supported in journaling openings 141 (FIG. 10) formed in the slide frame unit 178 and the pivoted support frame unit 181. Thus, the pivoted support frame unit 181 and the removable cylindrical shaft member 185 cooperate to form a pivot axis about which the the user seat back member 186 may pivot relative to the user seat member 180 without obstruction. The removable cylindrical shaft member 185 may be removable from the journaling openings 141 such that the seat back member 186 may be detached from the user seat member 180.

Figure 6:
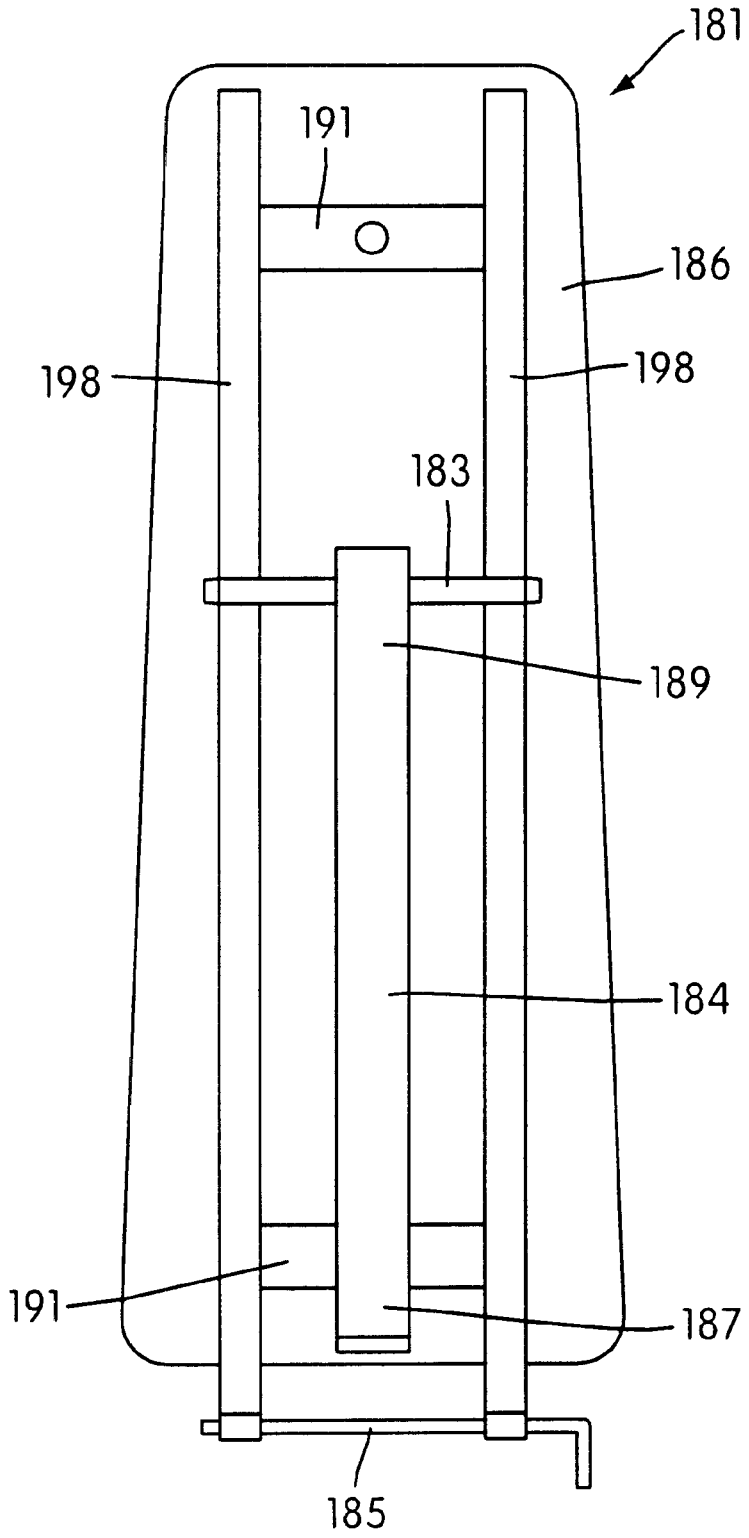
FIG. 6 is a bottom plan view of the user seat back of FIG. 1.

FIG. 6 best illustrates the pivoted support frame unit 181 and the seat back member 186. One end 189 of the pivoted strut frame 184 is connected to the seat back member 186. The pivoted support frame unit 181 includes a pair of longitudinally elongated support members 198 and a pair of cross support members 191, which are fixedly secured to the seat back member 186. A cylindrical shaft 183 extends through a through hole (not shown) in the end 189 of the pivot strut frame 184 and is fixedly secured to each of the longitudinally elongated support members of the pivoted support frame unit 181. The end 189 of the pivot strut frame 184 is pivotally connected to the shaft 183 so that the pivot strut frame 184 may be pivoted relative to the seat back member 186.

Figure 13:
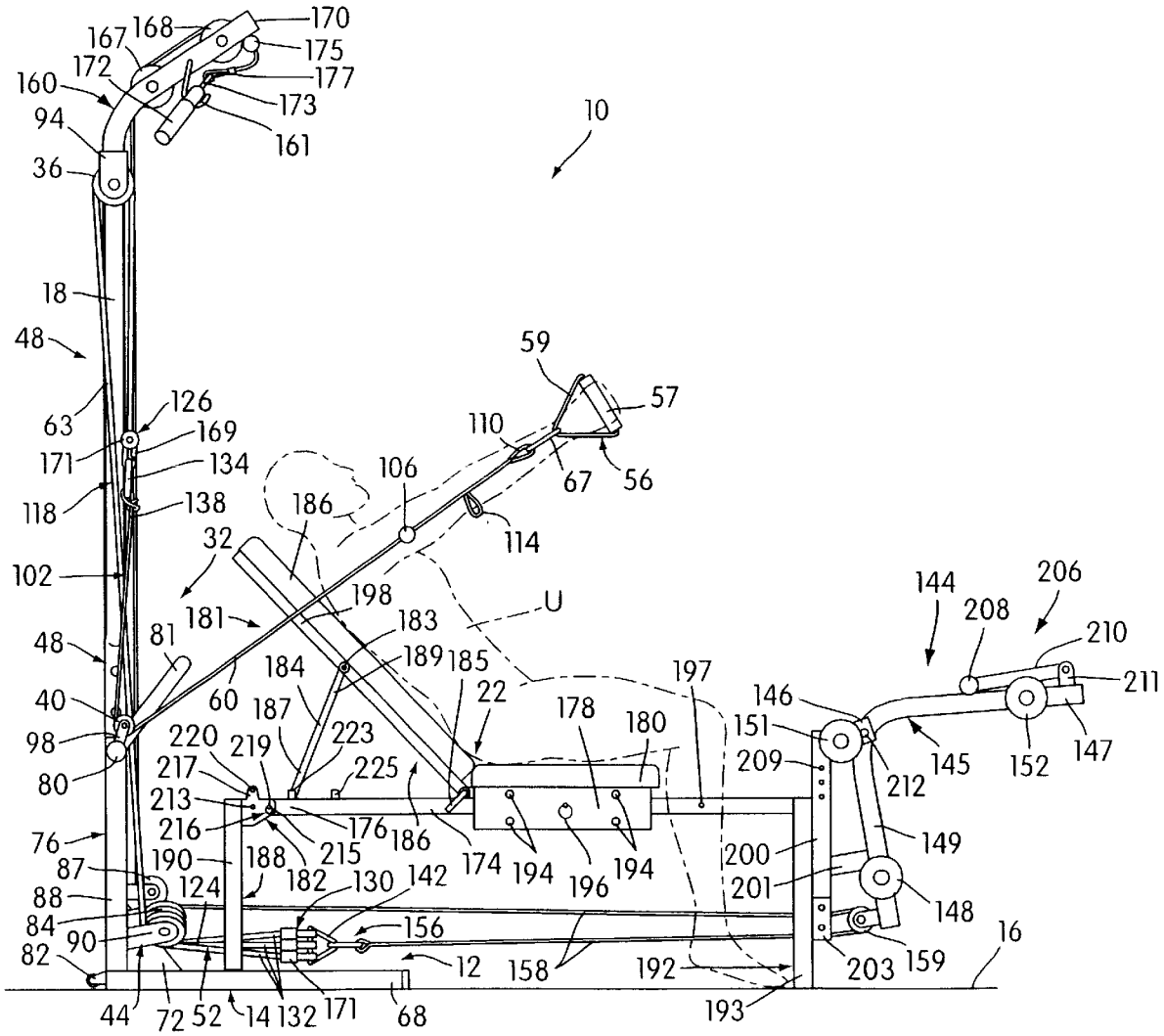
FIG. 13 is a side view of the exerciser of FIG. 3 but showing the hand grip units being extended away from the lower pulley members while a user is effecting a bench press or chest fly exercise.

As best illustrated in FIGS. 3 and 13, a pair of U-shaped mounting brackets 223, 225 extends upwardly from the elongated support member 174 in spaced relation with respect to one another in the longitudinal direction along the elongated support member 174. Each mounting bracket 223, 225 may have an opening (not shown) formed therethrough for receiving a removable pin, such as a similar removable pin as the removable pin 163 described above, therethrough. The free ends of the mounting brackets 223, 225 open upwardly so that the pivoted strut frame 184 may be received therebetween. Another end 187 of the pivoted strut frame 184 may be pivotally connected through the openings in the mounting brackets 223, 225 of either one of the mounting brackets 223, 225 by a cylindrical shaft, such as, for example, a releasable locking pin.

Pivotally connecting the end 187 between the free ends of the mounting bracket 223 generally decreases the angle at which the user seat member 180 and the seat back member 186 are positioned with respect to one another. In other words, the seat back member 186 may be disposed at a steeper inclination with respect to the user seat member 180 by pivotally connecting the end 187 between the free ends of the mounting bracket 225.

The pivoted support frame unit 181 and the pivoted strut frame 184 constitute the seat back mounting structure. The seat back mounting structure is moved between an inline bench position and an upright position thereof. In the inline bench position, the seat back 186 extends in generally horizontally aligned relation to the user seat member 180 and the pivoted strut frame 184 is moved into a position between the mounting structures 223, 225, which are upwardly extending from the elongated support member 174.

In the upright position, the pivoted strut frame 184 extends generally inwardly in inclined relation to the user seat member 180 in response to the movement of the user seat member 180 between the outer and inner positions thereof, respectively. One of the ends 187, 189 of the pivoted strut frame 184 is releasably secured between the free ends of either mounting bracket 223, 225.

The slide frame unit 178 includes a series of rollers 194. The rollers 194 are conventionally secured to the slide frame unit 178, such as for example, by fasteners, so as to engage oppositely facing sides of the elongated support member 174. The rollers 194 are constructed and arranged to roll along the elongated support member 174 in rolling relation thereto as the user seat member 180 is moved between the inner or outer positions thereof, such as during the rowing exercise shown in FIG. 10.

A releasably engageable lock 196 is disposed in operative relation between the slide frame unit 178 and the elongated support member 174. The releasably engageable lock 196 releasably locks the user seat member 180 in either of the inner or outer positions thereof by extending through the horizontally aligned holes 197, 199, respectively, in the elongated support member 174.

In an alternative embodiment not shown, the elongated support member 174 may be telescopically constructed so as to permit movement of the user seat member 180 from the outer position thereof to the inner position thereof by moving the elongated support member in a telescoping manner.

The elongated support member 174 is pivoted at its end 176 so as to be moved between the operative position thereof and an upright storage position. In the operative position, the fastener-receiving holes in the elongated support member 174 align with the fastener-receiving holes 219 in the projecting flange 215. By inserting the removable pin 216 through the aligned holes, the elongated support member 174 may be releasably locked into its operative position.

In the storage position, the elongated support member 174, an outer leg structure 192 and the seat and seat back members 180, 186 are pivoted about the end 176 so as to be positioned alongside the upright frame member 162 and the mounting support member 76. In the storage position, the fastener-receiving holes in the elongated support member 174 align with the fastener-receiving holes 220 in the upwardly extending flange 217. By inserting the removable pin 216 through the aligned holes, the elongated support member 174 may be releasably locked into its storage position.

The outer leg structure 192 is generally U-shaped and opens downwardly to have a pair of spaced ends 193. The outer leg structure 192 is fixed, preferably by welding, to the elongated support member 174. The spaced ends 193 of the outer leg structure 192 engage and are supported on the horizontal surface 16 in spaced relation to the frame 12. The spaced legs 193 support the elongated support member 174 while the elongated support member 174 is in the generally horizontally outwardly extending relation from the U shaped member 188 and the lower frame portion 14. A support member 202 extends between the spaced ends 193 of the outer leg structure 192 so as to provide support to the user support assembly 22 when a user is positioned thereon.

Extending vertically from the mid-portion of the outer leg structure 192 is an arm support mounting member 200. The arm support mounting member 200 has a hollow transverse cross section, preferably substantially rectangular in form so as to provide sufficient mounting structure for the leg-engaging unit 144. A rubber stop member 201 is mounted on the arm support mounting member 200. The angled portion 149 of the leg-engaging unit 144 abuts the rubber stop member 201 when in the normal inoperative position thereof.

As illustrated in FIGS. 1–3 and 7–14, it may be preferable to fixedly mount a pair of rollers 203 to the lower portion of the arm support mounting member 200. However, the pair of rollers 203 may be fixedly mounted to the lower portion of the support member 202 as well. The pair of rollers 203 may be configured to facilitate movement of the elongated flexible non-extensible element 158 thereby as the leg-engaging unit 144 is moved from the inoperative position thereof to the extended position thereof. For example, the pair of rollers 203 roll when the elongated flexible non-extensible element 158 moves thereby to allow smooth movement of the leg-engaging unit 144. The pair of rollers 203 may engage the elongated flexible non-extensible element 158 in rolling relation to thereby reduce frictional wear on the elongated flexible non-extensible element 158 during movement.

An upper arm supporting pad 204 has a mounting member 205 extending downwardly therefrom to extend into the arm support mounting member 200. The mounting member 205 is secured within the hollow configuration of the arm support mounting member 200 by a fastener such that the arm supporting pad 204 is downwardly angled toward the leg-engaging unit 144.

It may be preferable for the fastener to be a pin and opening arrangement whereby a pin 207 is removably received through a series of vertically spaced aligned openings 209 extending through the arm support mounting member 200 and the mounting member 205. The openings 209 are disposed in vertically spaced relation in a series. The pin 207 may be removably received through any two of the series of aligned openings 209 to allow height adjustment of the upper arm supporting pad 204 for accommodating users of different physical sizes. The pin 207 may be removed from the openings 209 to remove the upper arm supporting pad 204 and the mounting member 205 from the arm support mounting member 200. The upper arm supporting pad 204 and the mounting member 205 may also be fixedly attached to the arm support mounting member 200, for example, by welding. Other fasteners capable of fixedly attaching the upper arm supporting pad 204 and the mounting member 205 to the arm support mounting member 200 may be used.

An arm lift unit 206 includes a pair of horizontally aligned and fixedly spaced hand-engaging members 208. The hand-engaging members 208 are attached to a linkage bar 210, which is pivotally mounted to the generally straight portion 147 of the L-shaped member 145 by a U-shaped bracket member 211 in spaced relation from the outer end 146. The linkage bar 210 may be a chain or any other rigid structure for connecting the hand-engaging members 208 to the leg-engaging unit 144.

The arm lift unit 206 enables a user supported on the user support assembly 22 with their upper arms engaged on the arm-engaging pad 204 to move the leg-engaging unit 144 from the inoperative position thereof to the extended positions thereof.

The outer end 146 of the user support assembly 22 upwardly and outwardly extends from the arm support mounting member 200. The outer end 146 pivotally mounts the leg-engaging unit 144 thereto by a pivot pin 212 so that the user may move the leg-engaging unit 144 away from the normal inoperative position thereof into the desired extended position. Due to the arrangement of the elongated flexible non-extensible element 158 and the pulley member 159, when the leg-engaging unit 144 is moved away from the normal inoperative position thereof into the desired extended position, the resistance provided thereto may be essentially doubled.

Although the construction of the exerciser 10 has been described hereinabove having the leg-engaging unit 144 connected with the hand grip bar assembly 160, a second exemplary embodiment may include an exerciser having the leg-engaging unit 144 and the hand grip bar assembly 160 as separate, independent moving assemblies.

For example, the guide pulley member 87 may be removed from the mounting support member 76 and the elongated flexible non-extensible element 158 may be divided into two elongated flexible non-extensible elements, a first elongated flexible non-extensible element being provided for the leg-engaging unit 144 and a second elongated flexible non-extensible element being provided for the hand grip bar assembly 160. The first elongated flexible non-extensible element may be fixedly secured to the mounting support member 76 at one end thereof and the connector 156 at the opposite end thereof. By securing the first elongated flexible non-extensible element to the mounting support member 76, the leg-engaging unit 144 would be selectively operable by connecting the connectable and disconnectable connector 156 to the third connecting terminal 142, as will be further described below.

The second elongated flexible non-extensible element might extend downwardly toward the lower frame portion 14 such that a selectively connectable and disconnectable connector, similar to hook connectors 126, 130, could be fixedly secured thereto. The connector could then be selectively connected to the third connecting terminal 142 so as to render the hand grip bar assembly 160 selectively operable, as will be further described below.

With the leg-engaging unit 144 and the hand grip bar assembly 160 being separate, independent moving assemblies, the operations thereof are similar to that described below. However, the user may selectively switch the connecting terminal 142 from being used with the leg-engaging unit 144 to being used with the hand grip bar assembly 160. For example, the third connecting terminal 142 may be disconnected from the connector 156 and connected the connector suspended from the second elongated flexible non-extensible element of the hand grip bar assembly 160 instead.

Alternatively, the pulley member 159 may be replaced with a connecting element, i.e., a metal connector, such that the first elongated flexible non-extensible element directly connects with the leg-engaging unit 144. That way, the first elongated flexible non-extensible element connects to the third connecting terminal 142 at one end thereof and to the leg-engaging unit 144 via the connecting element at an opposite end thereof. By replacing the pulley member 159 with a connecting element, the amount of resistance provided to the leg-engaging unit 144 by the bungee cords 63 is not changed, i.e., the resistance is not increased.

Operation

In FIGS. 7–13, a user U is shown schematically. Motions of the user's arms, legs, or body, as well as motions of the moveable parts of the exerciser 10 are illustrated by broken lines. Resistance is provided by the resilient bungee cords 63 and can be adjusted to suit the user's requirements and physical abilities, as described above. Various exercises are described below in connection with different positions of the user.

Before certain hand, arm or chest exercises can be performed, each hand grip unit 56, 58 must be attached to the respective moving assembly 32, 34. To attach the hand grip units 56, 58, the user U latches each hand grip unit 56, 58 to either the respective looped end portion 110, 112 or to the respective looped intermediate portion 114, 116 depending on the user's physical size. For example, a user of large physical size may be more comfortable with the hand grip unit 56, 58 attached to the looped intermediate portions 114, 116.

The exercises illustrated in FIGS. 7, 8, 9, 11 and 12 are performed with the user support assembly 22 in the outside position thereof. The exerciser 10, however, enables the user U to execute a variety of physical exercises with the user support assembly 22 in the upright or inside position thereof. (FIG. 3).

The hand grip units 56, 58 are identical in construction and operation, therefore only the operation of the hand grip unit 56 will be described below.

After latching the hand grip unit 56 to one of the looped portions 110, 114, the user U may perform various arm, chest and shoulder exercises therewith by moving the hand grip unit 56 away from the pulley member 40.

As shown in FIGS. 1–3 and 7–14, the first connecting terminal 134 is connected with the flexible elongated non-extensible element 102 via the upper hook element 126. That way, the first connecting terminal 134 and the flexible elongated non-extensible element 102 move substantially in the same direction when the moving assembly 32 is moved away from the normal and operative position thereof. Particularly, as the hand grip unit 56 is moved away from the lower pulley member 40, the lower hook connector 130 engages the lower bungee cord stop structure 90, which in turn, allows the moving assembly 32 to be manually moved downwardly away from the normal inoperative position thereof.

The bungee cords 63 may be constructed such that the hook elements 126, 130 are permitted to move relatively away from one another so that the manual movement of the first and second moving assemblies 32, 34 away from the inoperative positions thereof cause the first and second connecting terminals 132, 134 to move away from the third connecting terminal 142. The bungee cords 63 connected to the first and second connecting terminals 132, 134 provide resilient resistance throughout the operative extent thereof to the movement of the first and second moving assemblies 32, 34 away from the inoperative positions thereof.

Without sufficient manual force on the hand grip unit 56 away from the lower pulley 40, the bungee cords 63 provide a resilient bias throughout the operative extent thereof to move the first and third connecting terminals 134, 142 toward one another. The resilient bias of the bungee cords 63 will move the moving assembly 32 toward the normal inoperative position thereof until the stop element 106 on the flexible elongated non-extensible element 102 abuts the stop structure 98.

During various exercises, as will be described in greater detail below, it may be preferable for the user U to maintain manual force on the hand grip unit 56 away from the lower pulley member 40. That way, the bungee cords 63 provide continuous resilient resistance to the exercised muscle throughout the exercise.

It may be preferable for the lower hook element 130 to be precluded from movement so that the lower hook element and will not abut the lower pulley member stop structure 90 when the first and second moving assemblies 32, 34 are in the inoperative positions thereof. For example, the lower hook element 130 may be connected with the leg-engaging unit 144 and/or the hand grip bar assembly 160 via the third connecting terminal 142.

Figure 8:
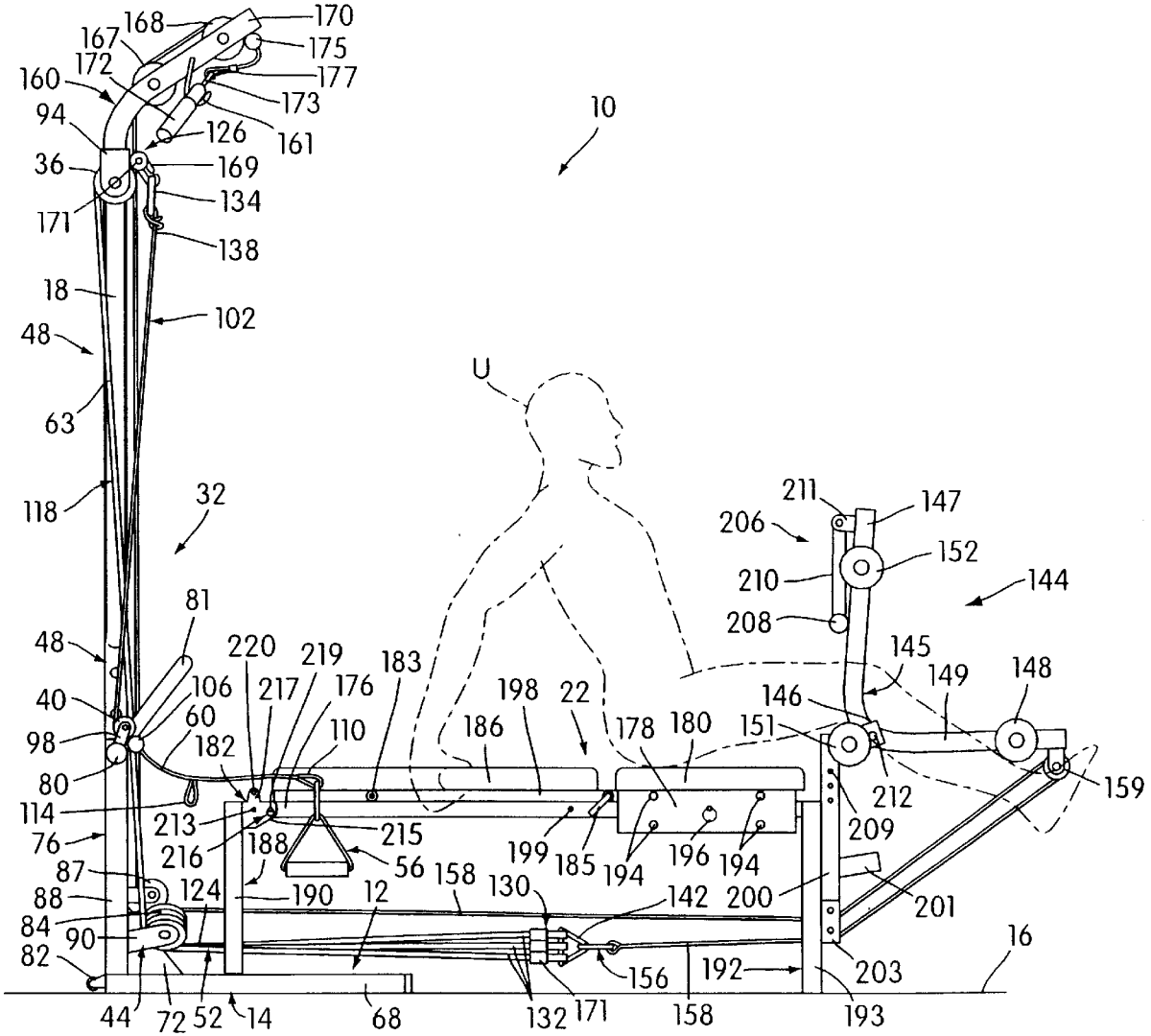
FIG. 8 is a side view of the exerciser of FIG. 2 but showing the arm lift unit removed from the exerciser and the leg-engaging unit being extended away from the user support assembly while a user is effecting a leg extension exercise.

The operation of the leg-engaging unit 144 will now be described (FIGS. 2 and 8). To prepare the leg-engaging unit 144 for certain leg exercises, the user U connects the lower hook element(s) 130 to the third connecting terminal 142 so that the bungee cord 63 may provide resilient resistance to the leg-engaging unit 144. The hook element(s) 130 and the connector 156 are connected to the third connecting terminal 142 so that they move together as the leg-engaging unit 144 is moved into its extended position.

Movement of the leg-engaging unit 144 away from the inoperative position thereof causes the third connecting terminal 142 to move away from the first and second connecting terminals 134, 136. Thus, enabling the bungee cords 63 connected to the first and second connecting terminals 134, 136 to provide resilient resistance throughout the operative extent thereof to the movement of the leg-engaging unit 144 away from the inoperative position thereof.

As the leg-engaging unit 144 is moved towards its extended position, the L-shaped member 145 is pivoted about the outer end portion of 146. The flexible non-extensible element 158 slides between the pair of rollers 203 so as to allow the leg-engaging unit 144 to move smoothly from the normal inoperative position thereof into the desired extended position thereof. In the extended position, the angled portion 149 is disposed in substantially parallel relation with respect to the horizontal surface 16.

The operation of the hand grip bar assembly 160 will now be described (FIGS. 1–3 and 12).

It will be appreciated that the third connecting terminal 142 need not be disconnected from the connector 156 to prepare the hand grip bar assembly 160 for certain arm, chest and shoulder exercises. Since the connector 156 remains connected to the third connecting terminal 142, the user may quickly switch from using either the leg-engaging unit 144 or the hand grip bar assembly 160 to using the other of the two operable assemblies 144, 160.

When the third connecting terminal 142 is connected to the hook connector 156, the resilient bias of the bungee cords 63 causes the stop element 175 positioned on the flexible non-extensible element 158 to abut against the uppermost pulley 168 and the inclined portion 170. The stop element 175 remains stationary while the third connecting terminal 142, which remains connected to the connector 156, moves in substantially the same direction as the hook connector 156 when the hand grip bar assembly 160 is engaged and moved away from the normal inoperative position thereof.When moved away from the normal inoperative position thereof, the manually engageable hand grip bar 172 is moved toward a desired extended position thereof by manual force exerted by a user U supported on the user support assembly 22. As the hand grip bar 172 is moved away from its normal inoperative position and toward its desired extended position, the bungee cords 63 provide resilient resistance to the movement thereof as the hand grip bar 172 is moved. The stop element 175 and the latching mechanism 177 move together with the hand grip bar 172 as the hand grip bar 172 is moved away from its normal inoperative position.

The operation of exerciser 10 has been fully described above, however, to show the versatility of the exerciser 10 various exercise examples will be described in greater detail below.

Although exercises can be performed individually or successively, it is contemplated that the exercises described herein may be performed in any sequence. An exemplary workout having a particular exercise sequence is described below.

Figure 7:
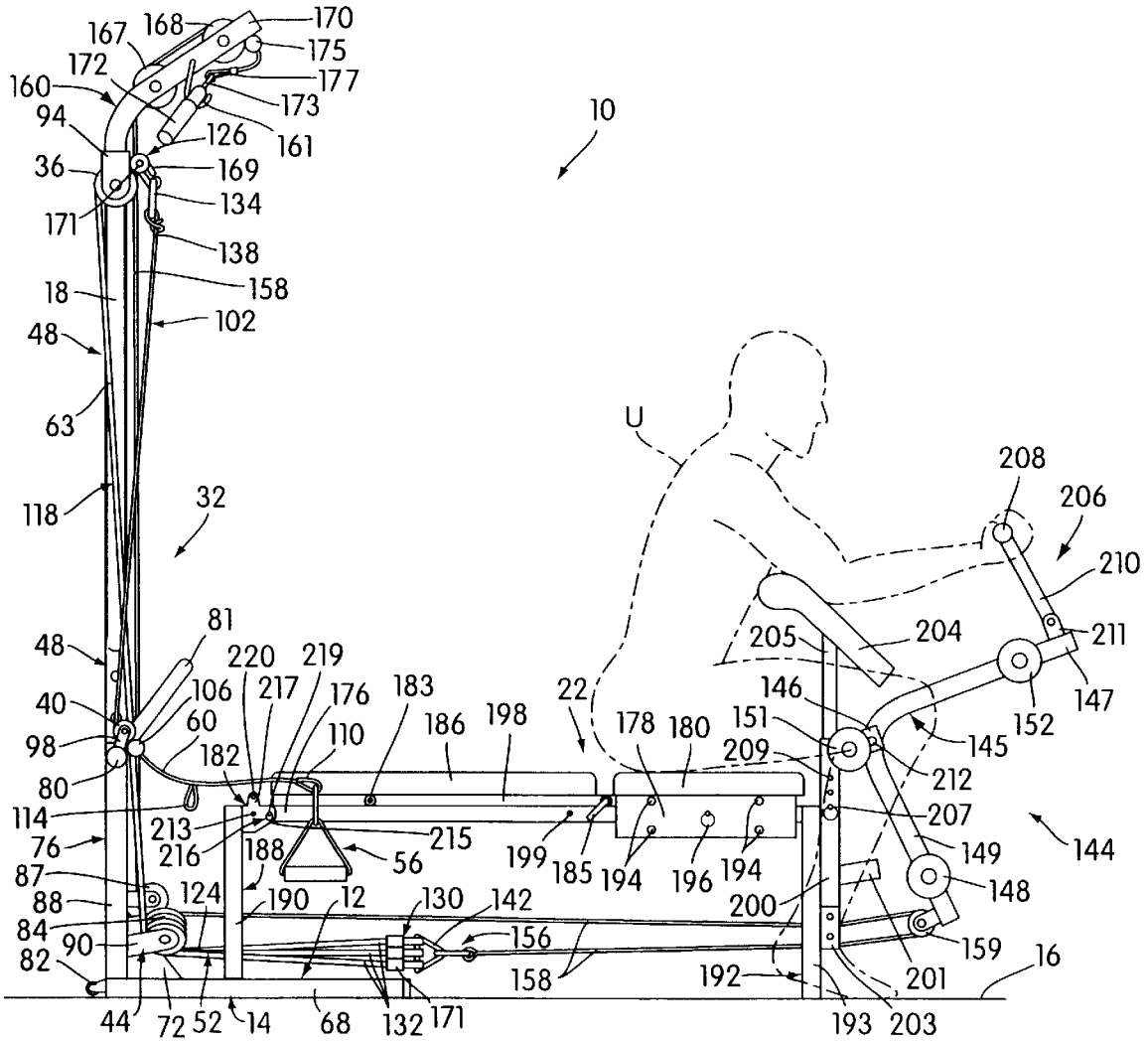
FIG. 7 is a side view of the exerciser of FIG. 2 but showing the arm lift unit being operated to cause the leg-engaging unit to be extended away from the user support assembly while a user is effecting an arm curl exercise.

As shown in FIG. 7, the hand grip units 56, 58 are latched to the looped end portions 110, 112, respectively, and the third connecting terminal is connected to the connector 156. The user support assembly 22 is in its inline bench position thereof or outer position thereof so that the user seat member 180 and the seat back member 186 are substantially parallel to the horizontal surface 16.

First, the user U straddles the user seat member 180 with his/her feet so as to face the leg-engaging unit 144. The user's lower legs (i.e., their shins) engage the leg-engaging members 148, 150 and the user's upper legs (i.e., the back of their knees) engage the leg-engaging members 151, 153 that are mounted to the angled portion 149. The user U may then be seated on the user seat member 180 such that the user's upper legs rest on the leg-engaging members 151, 153. The user's upper arms (i.e., their tricep muscle area) are supported on the upper arm supporting pad 204. The mounting member 205 and the upper arm supporting pad 204 may be vertically adjusted in accordance with the user's physical size.

As best shown in FIG. 7, once positioned on the user seat member 180 with their upper arms on the upper arm supporting pad 204, the user may perform a preacher curl exercise. To perform the preacher curl exercise, the user U would manually grasp the hand-engaging members 208 with an under the handle grip (palms facing upward). The user U would then pull the hand-engaging members 208 toward his/her shoulders, which in turn, causes the linkage bar 210 attached to the straight portion 147 to move the leg-engaging unit 144 from its normal inoperative position into its desired extended position. The bungee cords 63 provide resistance to the movement of the leg-engaging unit 144 as described above and the user U is able to exercise his/her bicep muscle.

Alternatively in this position and not shown, the user U may vary his/her grip from an under the handle grip on the hand-engaging members 208 to an over the handle grip on the hand-engaging members 208. By switching his/her grip on the hand-engaging members 208 and by pulling the hand-engaging members 208 toward his/her shoulders, the user U may exercise different muscles (i.e., their forearm).

In some instances, it may be preferable for the user U to use his/her legs during the preacher curl exercise to assist his/her arms in moving the leg-engaging unit 144 from its normal inoperative position into its desired extended position. By using his/her legs to help move the leg-engaging unit 144 into its desired extended position, the user U may have a higher load on his/her arms during the return or "negative" stroke. In the "negative" stroke, the leg-engaging unit 144 is returned to its normal inoperative position from its desired extended position. As a result of this technique, the user U could resist more weight or resistance than he/she could lift using only his/her arms during the "negative" stroke of the preacher curl exercise, which may help the user U build more muscle mass.

While sitting on the seat member 180 after finishing the preacher curl exercise, the user U may remove the mounting member 205 and the upper arm supporting pad 204 from the arm support mounting member 200 by removing the pin 207 from the horizontally aligned openings 209. The pin 207 may then be replaced through the openings 209 in the mounting member 205 once the mounting member 205 is removed from the arm support mounting member 200.

With the mounting member of 205 and the arm supporting pad 204 removed from the arm support mounting member 200, the user U may easily access the leg-engaging unit 144 to perform a leg extension exercise or a leg-curl exercise, as best shown in FIG. 8.

To perform the leg extension exercise, the user U remains in the same position as during the preacher curl exercise and extends his/her legs forwardly and outwardly from the outer leg structure 192 until his/her legs are substantially parallel with the horizontal surface 16. This movement causes the leg-engaging members 148, 150 of the leg-engaging unit 144 to move from the normal operative position thereof into the desired extended position thereof and provides resilient resistance to the user's legs, especially their quadriceps muscle. While performing a leg extension exercise, the user U may hold onto the seat back member 186 or user seat member 180 for additional support. Also, the user U may grasp the hand-engaging members 208 during the leg extension exercise to assist the leg-engaging unit 144 in moving from its normal inoperative position to its desired extended position. By using his/her arms to help move the leg-engaging unit 144 into its desired extended position, this technique allows the user U to have a higher load on his/her legs during the return or "negative" stroke. That way, the user U can resist more weight or resistance than he/she could lift using only his/her legs during the "negative" stroke of the leg extension exercise, which may help the user U build more muscle mass, as described above.

After the leg extension exercise, the user U may perform the leg-curl exercise. To perform the leg-curl exercise, the user U would reposition himself/herself on the user support assembly 22. The user U repositions himself/herself by standing up from his/her seated position on the user seat member 180. Then he/she moves to straddle the user seat member 180 with his/her feet so as to face the rigid upright support members 18, 20. The user's lower legs (i.e., their shins) engage the leg-engaging members 148, 150 and the user's upper legs (i.e., their thigh or quadriceps muscle) engage the leg-engaging members 151, 153.

The user U would then lay face down on the user support assembly 22 so that his/her legs (i.e., their calves) engage the leg curl members 152, 154. Once positioned, the user U may perform the leg curl exercise to exercise his/her hamstring muscle by bending his/her knee to move the angled portion 149 so that it is substantially parallel to the horizontal surface 16.

After finishing the leg curl exercise, the user U is finished with the leg-engaging unit 144 in the exemplary workout.

The user U may perform various arm, chest and shoulder exercises using the hand grip units 56, 58. For example, a bicep curl may be performed by the user U when he/she is standing above the seat back member 186 with his/her feet straddling the seat back member 186 so as to face the rigid upright support members 18, 20. The user U grasps the hand grip units 56, 58 so that his/her arms are fully extended downwardly and his/her palms face the rigid upright support members 18, 20. Then, the user U would bend his/her arms upwardly at his/her elbows so that the hand grip units 56, 58 would be pulled toward his/her shoulders. The bungee cords 63 resiliently resist this upward movement to exercise the bicep muscle of the user's arm.

Figure 9:
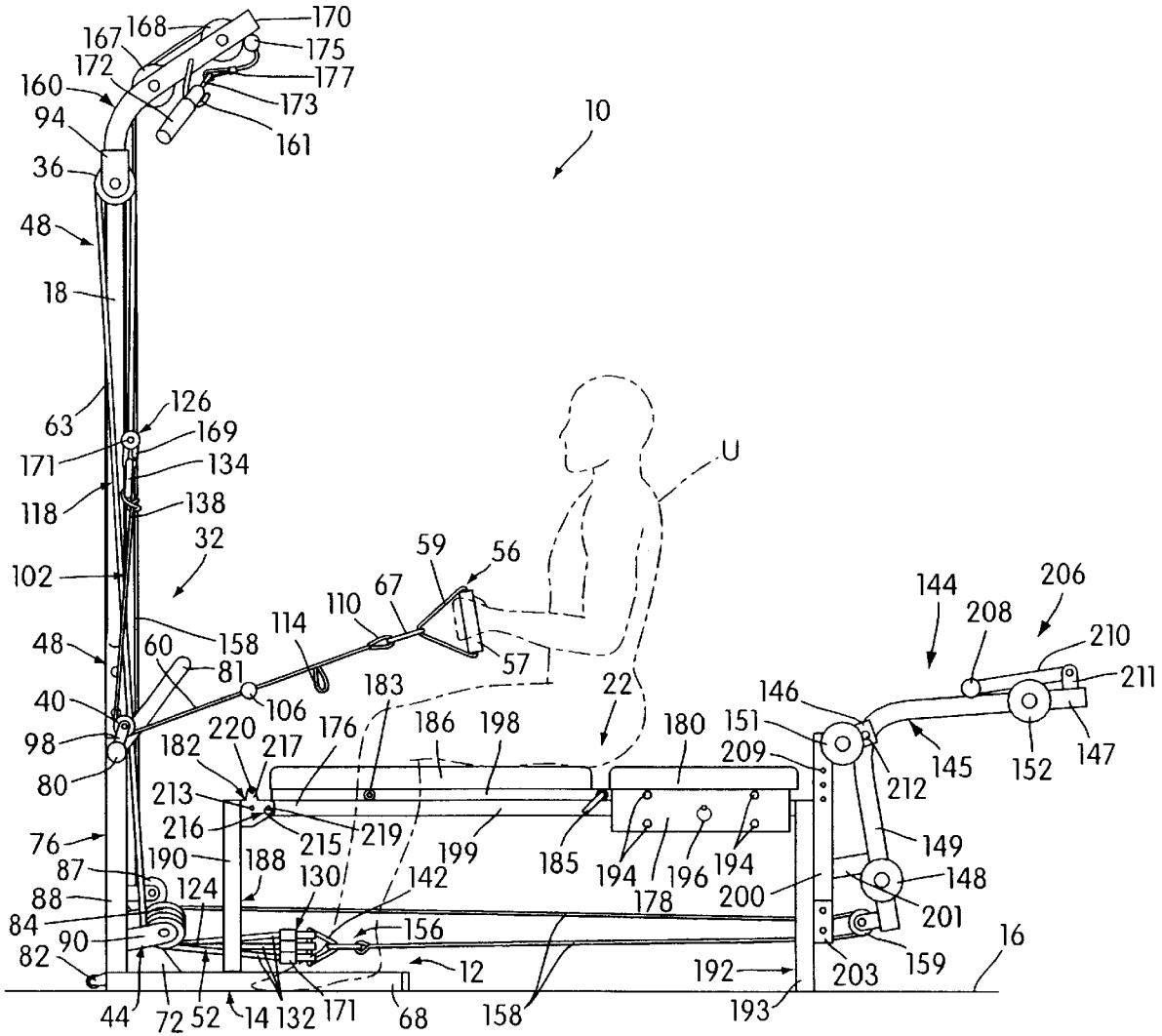
FIG. 9 is a side view of the exerciser of FIG. 2 but showing the hand grip units being extended away from the lower pulley members while a user is effecting a seated rowing exercise.
Figure 10:
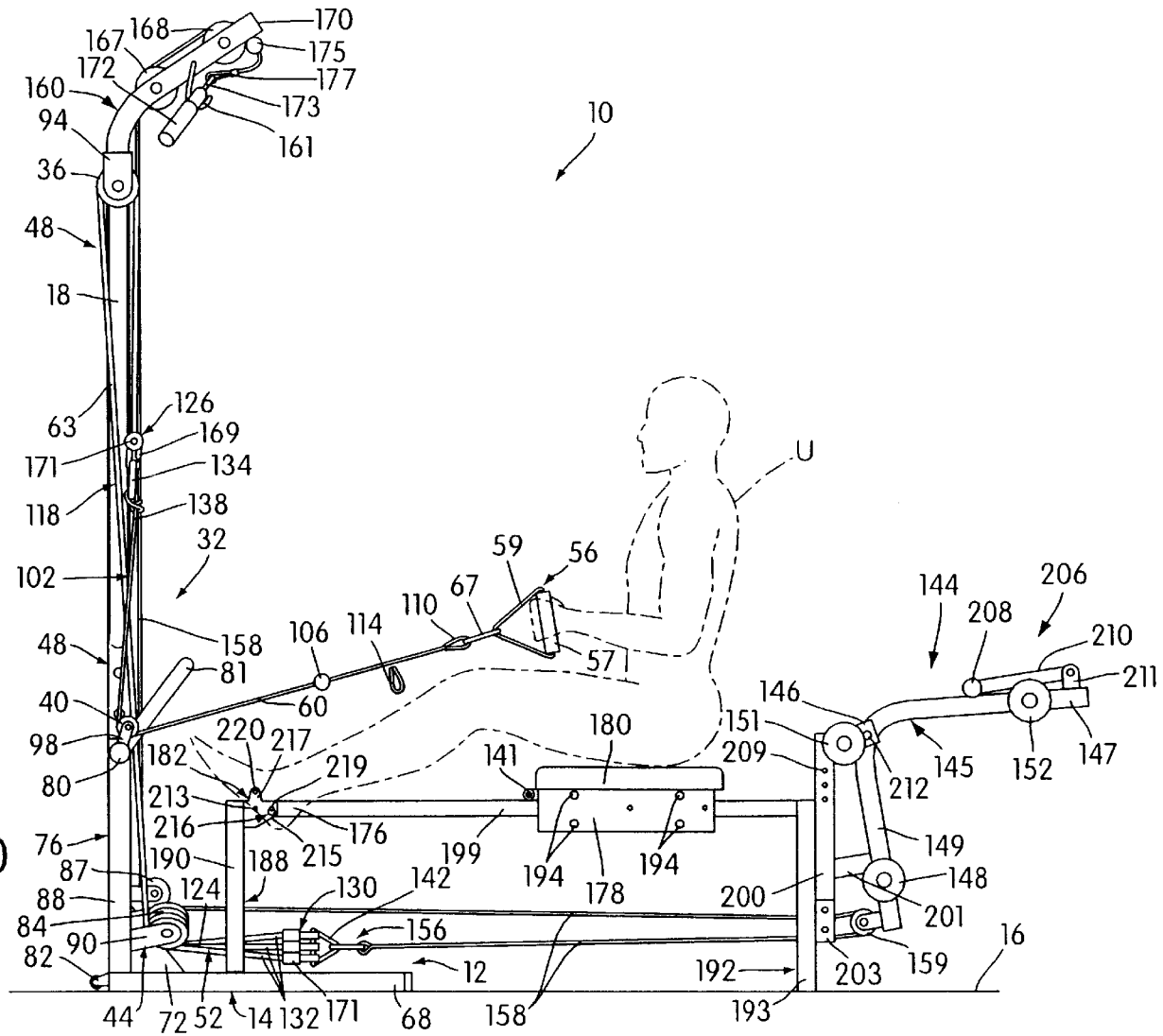
FIG. 10 is a side view of the exerciser of FIG. 2 but showing the hand grip units being extended away from the lower pulley members while a user is effecting an alternative seated rowing exercise.

FIGS. 9 and 10 illustrate two different seated rowing exercises. FIG. 9 shows one seated rowing exercise which may be performed by the user U by sitting on the seat back member 186 facing the rigid upright support members 18, 20. The user U grasps the hand grip units 56, 58 with an over the handle grip and slightly leans backward toward the leg-engaging unit 144. Then, the user U may clasp his/her fingers together so as to bring the hand grip units 56, 58 together. The user U pulls the hand grip units 56, 58 simultaneously toward his/her chest or abdomen against the resilient bias of the bungee cords 63.

The user U may not choose to clasp his/her fingers together when performing the seated row exercise, for example, due to personal preference. In this case, the hand grip units 56, 58 may be moved independently of one another against the resilient bias of the bungee cords 63.

Alternatively, FIG. 10 shows another seated rowing exercise. As illustrated, the user U may perform a different seated rowing exercise using the sliding capabilities of the user seat member 180. In this exemplary exercise, the user U might remove the removable cylindrical shaft member 185 of the pivoted frame support unit 181 from the journaling openings 141 to detach the seat back member 186 from the user seat member 180. Then, the user U may remove the releasably engageable lock 196 from the aligned holes 197 or 199 so that the user seat member 180 can slide along the elongated support member 174 in the longitudinal direction thereof. That way, instead of pulling the hand grips 56, 58 toward his/her chest or abdomen as in the above described seated rowing exercise, the user U might hold the hand grip units 56, 58 near his/her chest or abdomen and roll the user seat member 180 along the elongated support member 174 against the resilient bias of the bungee cords 63.

One way that the user U may roll the user seat member 180 along the elongated support member 174 via the sliding frame unit 178 would be to position his/her feet on the pulley mounting bar 80, the protruding member 81 or the spaced ends 190 of the support member 188 for support. FIG. 10 shows the user U supporting his/her feet on the spaced ends 190, however, the user U may choose to rest his/her feet on the protruding member 81. Then, by extending his/her legs outwardly, the user could move the user seat member 180 from end 176 of the elongated support member 174 to the opposite end 179 thereof against the resilient bias of the bungee cords 63.

The user U may reconnect the seat back member 186 and the user seat member 180 together by reinserting the cylindrical shaft member 185 through the journaling openings 141. It may be preferable for the user U to lock the user seat member 180 from moving by reinserting the releasably engageable lock 196 into the aligned openings 197, 199 before reconnecting the seat back member 186 thereto. Either way, once the seat back member 186 and the user seat member 180 are reconnected, the user U may perform other exemplary exercises described below.

Figure 11:
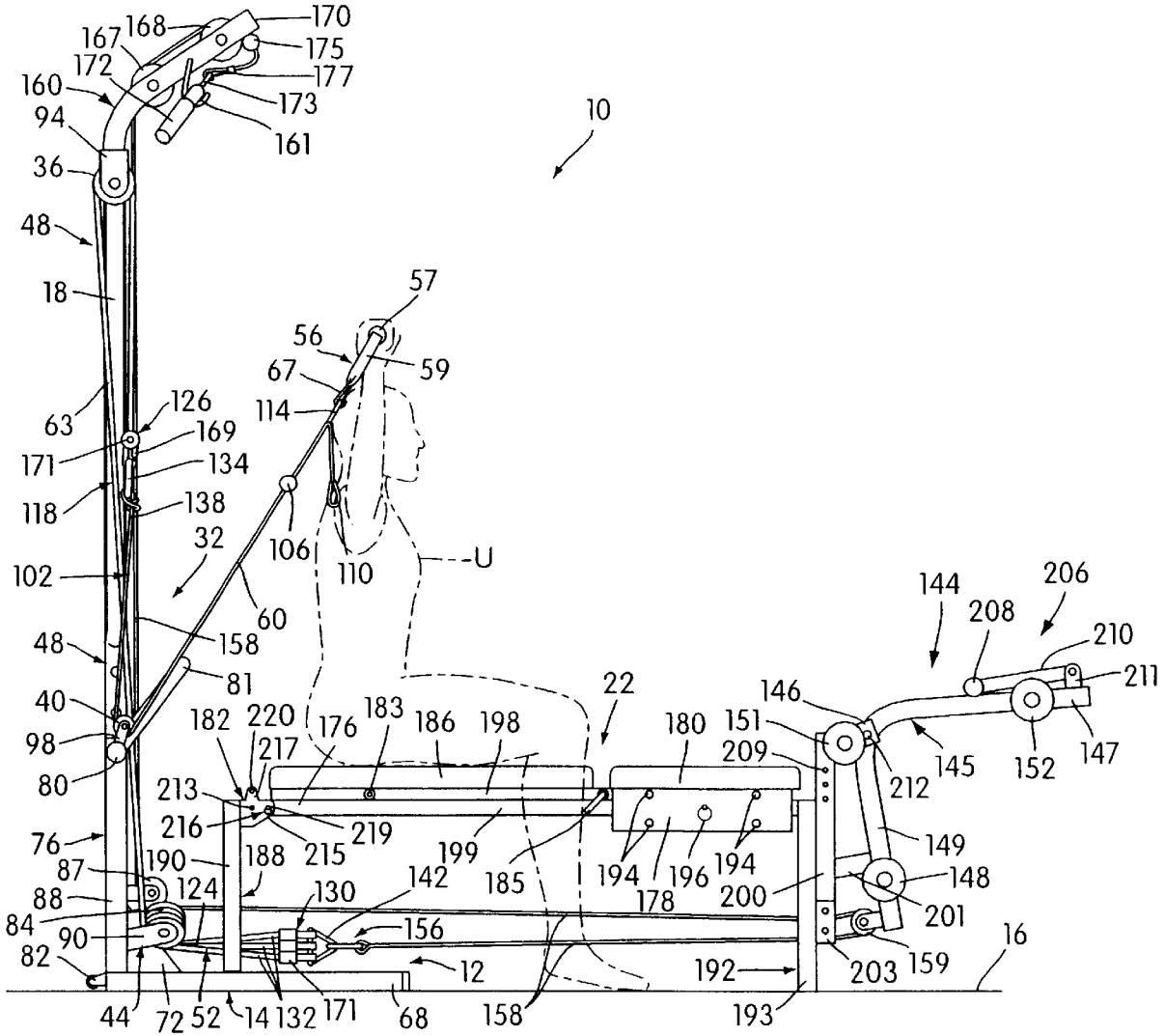
FIG. 11 is a side view of the exerciser of FIG. 2 but showing the hand grip units being extended away from the lower pulley members while a user is effecting a military press exercise.

As shown in FIG. 11, a military or shoulder press may be performed to exercise the arms and shoulders of the user U. First, the user U repositions himself/herself so as to be facing the leg-engaging unit 144 in a seated position on the seat back member 186. Then, the user U grasps the hand grip units 56, 58 with an over the handle grip and bends his/her arms so to position them laterally and inline with his/her shoulders with his/her palms face upwardly. The user U would then extend the hand grip units 56, 58 above his/her head so to extend his/her arms against the resistance of the bungee cords 63.

To perform arm, chest and shoulder exercises with the hand grip bar assembly 160, the user U may connect the latching mechanism 177 through the opening 173 in the hand grip bar 172 to secure the hand grip bar 172 to the elongated flexible non-extensible element 158. Alternatively, the user U may remove the hand grip bar 172 from the J-shaped supporting elements 161, if the hand grip bar 172 is already connected to the hand grip bar assembly 160.

Figure 12:
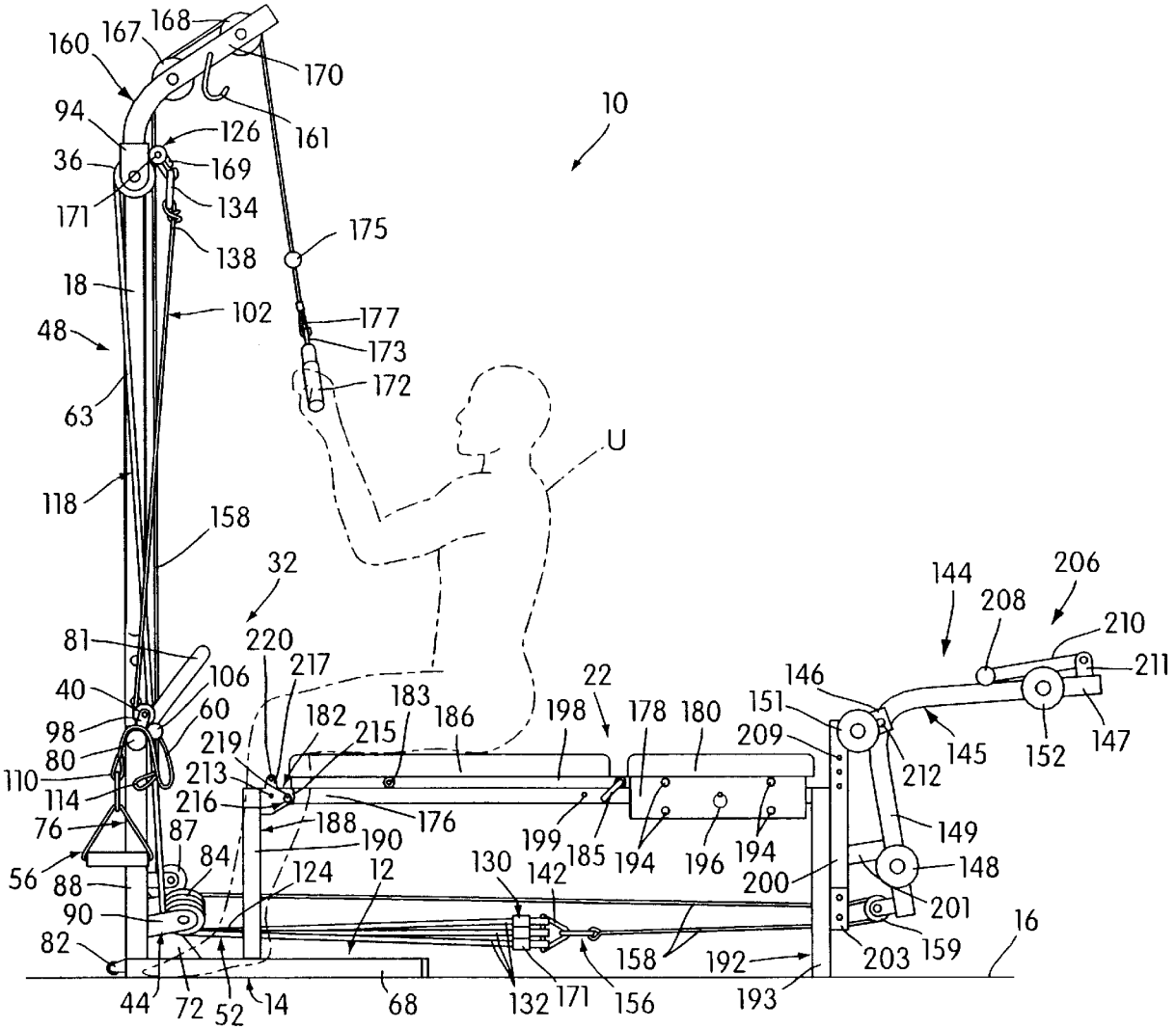
FIG. 12 is a side view of the exerciser of FIG. 4 showing the hand grip bar assembly connected to the exerciser and being extended toward the user support assembly while a user is effecting a lat pull down exercise.

As best shown in FIG. 12, the user U may sit in a seated position on the seat back member 186 so as to face the rigid upright support members 18, 20.

In this seated position, the user U may perform a lat pull down exercise, where the user U grasps the hand grip bar 172, slightly leans toward the leg-engaging unit 144, and pulls the hand grip bar 172 towards his/her chest or abdomen. Alternatively, another pull down exercise can be performed by the user U sitting vertically on the seat back member 186 and pulling the hand grip bar 172 toward the back of his/her neck. The user U may also perform the lat pull down exercise while facing the leg-engaging unit 144 in this seated position.

In the exemplary workout, the user U may then sit up from his/her seated position on the seat back member 186 so as to stand above the user seat member 180 with his/her feet straddling the user seat member 180, facing the rigid upright support members 18, 20. To perform the tricep pull down exercise (not shown), the user U manually grasps the hand grip bar 172 with an over the handle grip so that the user's arms are bent at an angle equal to or less than 90 degrees. As the user extends his/her arms downwardly so as to straighten his/her arms, the hand grip bar 172 is moved from the normal inoperative position thereof to the extended position thereof against the resilient resistance of the bungee cords 63 to exercise the user's triceps muscle.

As best shown in FIG. 13, a bench press exercise and/or a chest fly exercise may be performed to exercise certain arm, chest and shoulder muscles. However, to effect these exercises, it may be preferable to move the user seat member 180 from the outer position thereof into the inner position thereof such that the seat back member 186 is disposed at a upwardly sloping angle with respect to the user seat member 180.

In order to move the user support assembly 22, the user U removes the releasably engageable lock 196 from the aligned holes 197. That way, the user seat member 180 can move from the outer position thereof to the inner position thereof via the rollers 194 sliding along the elongated support member 174. The user seat member 180 is moved to its inner position along the elongated support member 174 and releasably locked in the inner position thereof by the releasably engageable lock 196 extending through the horizontally aligned holes 199.

The chest fly exercise may be performed with the user U in the seated position such that the angled seat back support member 186 supports his/her back. To perform the chest fly exercise, the user U would grasp the hand grip units 56, 58 and laterally extend his/her arms so that the hand grip units 56, 58 are extended away from his/her chest. Then, the user U moves the hand grip units 56, 58 in an forwardly arcuate, sweeping motion so as to bring the hand grip units 56, 58 together in front of his/her chest against the resilient resistance of the bungee cords 63. The user U would resist the resilient bias of the bungee cords 63 as he/she move his/her arms back to the laterally extended position in a rearwardly arcuate, sweeping motion.

Another exercise that may be performed with the user U sitting in the user seat assembly 22 when the user seat assembly 22 is in the inner position thereof is a bench press exercise, which exercises the arms and chest of the user U. The user U would grasp the hand grip units 56, 58 with an over the hand grip and bends his/her arms so to position them laterally and inline with his/her shoulders with his/her palms face forwardly. The user U would then extend the hand grip units 56, 58 forwardly away from his/her chest so to extend his/her arms against the resistance of the bungee cords 63.

The hand grip units 56, 58 may be stored on the pulley mounting member 80 when not in use. Also, the user U may grasp the hand grip units 56, 58 with different grips on the hand grip units 56, 58, e.g., an under the handle grip, so as to exercise different muscle groups of the user U for each exercise described hereinabove.

It may be preferable for the exerciser 10 to be stored in the storage position thereof after the user U completes his/her workout. In this case, after moving the user support assembly 22 into the inline bench position shown in FIG. 7, the user U might remove the removable pin 216 from the holes 219. Then, the user U pivots the user support assembly 22 with respect to the frame assembly 12 about the pivoted frame bracket member 182. This pivotal movement positions the user support assembly 22 substantially parallel to the mounting support member 76 such that the user support assembly 22 is spaced from the mounting support member 76. The user may then insert the removable pin 216 through the holes 220 to hold or retain the user support assembly substantially parallel to the mounting support member 76 in its storage position.

For example, the user U may lift the outer leg structure 192 upwardly such that the elongated support member 174 pivots within the pivoted frame bracket member 182. It may be preferable for the user U to place the hand-engaging members 208 within the J-shaped supporting elements 161 so that the user support assembly 22 is releasably secured in the storage position thereof. That way, the J-shaped supporting elements 161 may help retain the exerciser 10 in the storage position thereof. As a result, even if the removable pin 216 is removed from the pivoted frame bracket 182, either accidentally or deliberately, the J-shaped supporting elements 161 retain the hand-engaging members 208 therein and the user seat assembly 22 of the exerciser 10 will not move out of its storage position.

Figure 14:
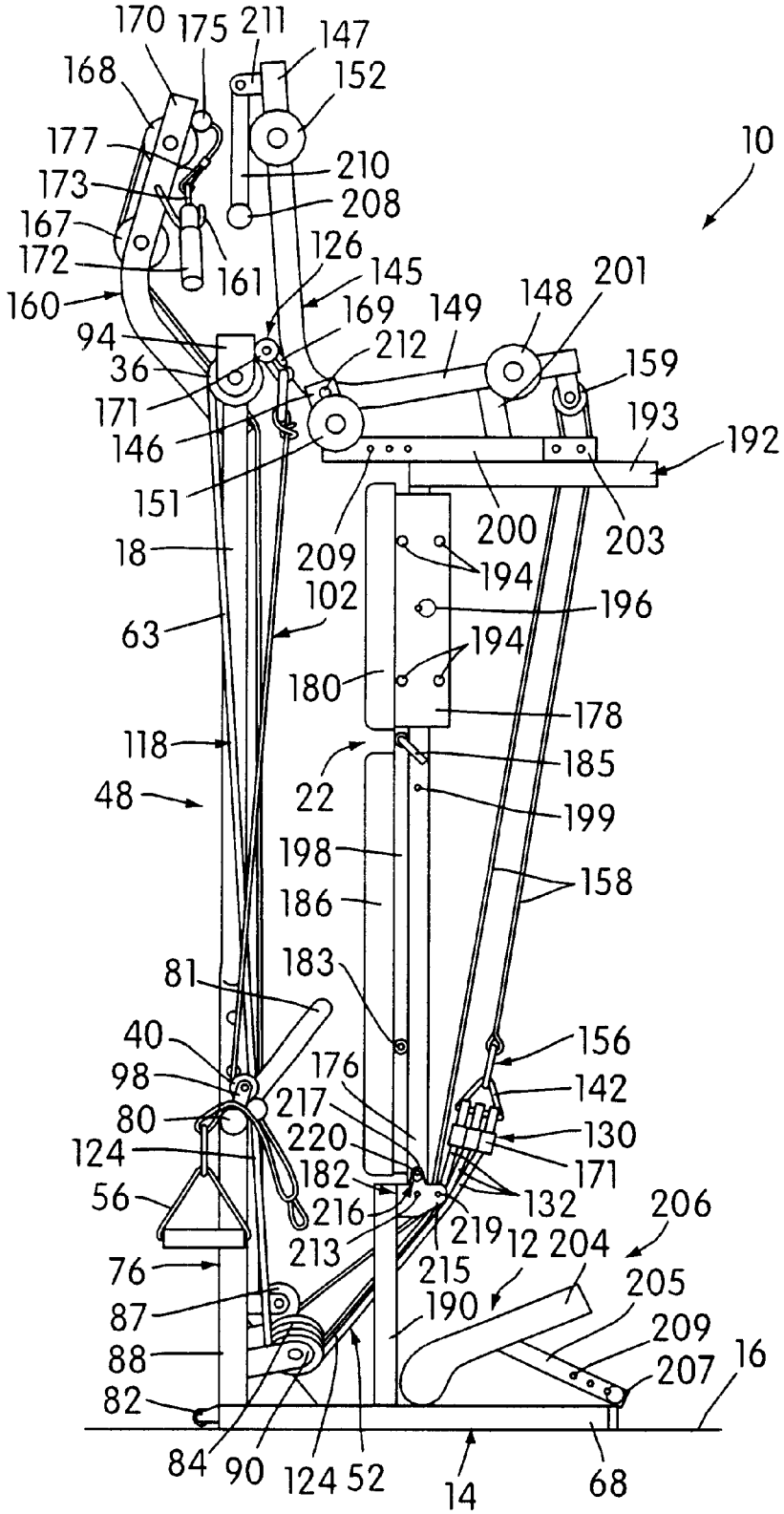
FIG. 14 is a side view of the exerciser of FIG. 1 showing the user seat assembly in the upright storage position thereof.

The hand grip bar 172 may also be supported in the J-shaped supporting elements 161 or may be removed therefrom and placed onto the cover plate 74 (as shown for the arm lift unit 206 in FIG. 14).

Once in the storage position thereof, the user U may transport the exerciser 10 to different locations of use by tilting the frame assembly 12 onto the rollers 82. By tilting the frame assembly 12 in a direction opposed to the direction of the outward extent of the user support assembly 22 when in the operative position, the rollers 82 can support the exerciser 10 thereon so as to facilitate movement thereof. The user U may tilt the frame assembly 12 onto the rollers 82 by holding onto the first and second rigid upright support members 18, 20 and pulling the support members 18, 20 backward (toward the rollers 82). It may be preferable to transport the exerciser 10 with the user support assembly 22 in the storage position thereof.

As further shown in FIG. 14, once the exerciser 10 is stored in the storage position thereof, the arm lift unit 206 may be stored on the cover plate 74.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. An exerciser comprising:

an upright frame assembly constructed and arranged to be disposed in an operative position supported on a horizontal surface, said upright frame assembly having a user support assembly constructed and arranged to support a user thereon;

first and second moving assemblies disposed in normal inoperative positions with respect to said user support assembly constructed and arranged to be manually engaged and individually manually moved away from the normal inoperative position thereof into a desired extended position by a user supported on said user support assembly;

a third moving assembly disposed in a normal inoperative position with respect to said user support assembly constructed and arranged to be engaged and moved away from the normal inoperative position thereof into a desired extended position by a user supported on said user support assembly;

first, second and third connecting terminals connected to said first, second and third moving assemblies respectively so that said first and third connecting terminals and said second and third connecting terminals move away from one another when any one of said moving assemblies is moved away from the normal inoperative position thereof;

a set of resilient resistance structures having operative extents constructed and arranged to be separately connected between said first and third connecting terminals and between said second and third connecting terminals so as to provide resilient resistance throughout the operative extent thereof to the relative movement of the first and third connecting terminals and the second and third connecting terminals away from one another and a resilient bias throughout the operative extent thereof to move the first and third connecting terminals and second and third connecting terminals toward one another;

said set of resilient resistance structures being related to said upright frame assembly such that the first and third connecting terminals and said second and third connecting terminals are restrained against biased movement toward one another beyond normal inoperative positions thereof corresponding generally with the normal inoperative positions of said moving assemblies while permitting relative movement away from one another so that (1) manual movement of said first moving assembly away from the inoperative position thereof causes the first connecting terminal to move away from the third connecting terminal enabling the resilient structure connected thereto to provide resilient resistance throughout the operative extent thereof to the movement of said first moving assembly away from the inoperative position thereof, (2) manual movement of said second moving assembly away from the inoperative position thereof causes the second connecting terminal to move away from the third connecting terminal enabling said resilient structure to provide resilient resistance throughout the operative extent thereof to the movement of said second moving assembly away from the inoperative position thereof, and (3) movement of said third moving assembly away from the inoperative position thereof causes the third connecting terminal to move away from the first and second connecting terminals enabling the set of resilient structures connected thereto to provide resilient resistance throughout the operative extent thereof to the movement of said third moving assembly away from the inoperative position thereof.

2. An exerciser as defined in claim 1, wherein said first and second moving assemblies comprise:

first and second upper pulley members rotatably mounted on said frame assembly;

first and second lower pulley members rotatably mounted on said frame assembly at fixed position s below said first and second upper pulley members;

first and second flexible elongated structures trained around said first and second lower pulley members and extending upwardly over said first an d second upper pulley members respectively and then downwardly toward a lower portion of said frame assembly;

movement preventing structures on said lower frame portion operatively associated with terminal portions of said first and second flexible elongated structures extending downwardly from said first and second upper pulley members constructed and arranged to prevent upward movements of said terminal portions; and a pair of user hand grip units connected with first and second end portions of said first and second flexible elongated structures extending outwardly from said first and second lower pulley members in positions to enable a user supported on said user support assembly to move said pair of user hand grip units away from inoperative positions thereof into desired extended positions;

said first and second flexible elongated structures including a set of bungee cords constructed and arranged to resiliently resist movement of said user hand grip units and the end portions of said flexible elongated structures away from the inoperative positions thereof into desired extended positions and to resiliently return said user hand grip units to the inoperative positions thereof when no longer moved by the user, said movement preventing structures including a series of lower pulleys rotatably mounted on the lower portion thereof, each having lower bungee cord stop structure extending across a peripheral portion thereof, each bungee cord of said set of bungee cords including a lower end portion trained about one of said lower pulleys and having a lower hook connector fixed on the terminal end of said lower end portion constructed and arranged to be selectively engaged with the third connecting terminal or an associated lower bungee cord stop structure whereby the number of lower hook connectors connected to said third connecting terminal determines the number of bungee cords resisting movement of the third moving assembly away from the inoperative position thereof.

3. An exerciser as defined in claim 2, wherein said upright frame assembly includes:

a lower frame portion constructed and arranged to be stablely supported in an operative position on a horizontal surface; and first and second rigid upright support members fixed at lower end portions thereof on said lower frame portion and extending upwardly from said lower frame portion when in the operative position thereof.

4. An exerciser as defined in claim 2, wherein said third moving assembly includes a third elongated flexible non-extensible element connected with said third connecting terminal.

5. An exerciser as defined in claim 4, wherein said third moving assembly includes a leg-engaging unit pivoted to an outer end portion of said user support assembly with which said third elongated flexible non-extensible element is connected, said leg-engaging unit having a pair of horizontally aligned and fixedly spaced leg-engaging members pivotally movable therewith from a normal inoperative position disposed outwardly of said user support assembly wherein a user supported on said user support assembly in enabled to engage lower forwardly facing portions with legs and move said leg-engaging members thereby from said inoperative position to an extended position spaced upwardly and outwardly from the inoperative position thereof.

6. An exerciser as defined in claim 5, wherein said third moving assembly includes a second pair of horizontally aligned and fixedly spaced leg-engaging members pivotally movable with said leg-engaging unit from a normal inoperative position spaced upwardly and outwardly from the inoperative position of said first-mentioned pair of leg-engaging members wherein a user supported on said user support assembly can engage lower rearwardly facing leg portions therewith and move said second pair of leg-engaging members thereto from said inoperative position to an extended position spaced inwardly and above the inoperative position of said second pair of leg-engaging members.

7. An exerciser as defined in claim 6, wherein the outer end portion of said user support assembly is constructed and arranged to receive in supported relation thereof an upper arm supporting pad in a position to be engaged by the upper arms of a user supported on said user support assembly and an arm lift unit is provided for enabling a user supported on said user support assembly with upper arms engaged on said upper arm-engaging pad to move said leg-engaging unit from the inoperative position of said first and second pairs of leg-engaging members to the extended positions thereof, said upper arm lift unit including a pair of horizontally aligned and fixedly spaced hand-engaging members and a linkage member extending from said pair of hand-engaging members to said leg-engaging unit in connected relation thereto in spaced relation to a pivotal axis thereof.

8. An exerciser as defined in claim 4, wherein said upright frame assembly includes a centrally located upright rigid frame member, said third elongated flexible non-extensible element extending over a third pulley on the upper end of said third elongated flexible non-extensible element, said third moving assembly also including a manually engageable pull down bar fixed to said third elongated flexible non-extensible element outwardly of said third pulley.

9. An exerciser as defined in claim 8, wherein said third elongated flexible non-extensible element includes one end connected to said third terminal and an opposite end connected to said pull down bar and including a portion trained about a third lower pulley spaced below said first mentioned third pulley and a fourth pulley forming a part of a fourth moving assembly, said fourth moving assembly includes a leg-engaging unit pivoted to an outer end portion of said user support assembly which carries said fourth pulley, said leg-engaging unit having a pair of horizontally aligned and fixedly spaced leg-engaging members pivotally movable therewith from a normal inoperative position disposed outwardly of said user support assembly wherein a user supported on said user support assembly in enabled to engage lower forwardly facing portions with legs and move said leg-engaging members thereby from said inoperative position to an extended position spaced upwardly and outwardly from the inoperative position thereof so that the movement of said fourth pulley with said leg-engaging members will move the third connecting terminal by said third elongated flexible non-extensible element while the opposite end thereof remains stationary.

10. An exerciser as defined in claim 9, wherein said third moving assembly includes a second pair of horizontally aligned and fixedly spaced leg-engaging members pivotally movable with said leg-engaging unit from a normal inoperative position spaced upwardly and outwardly from the inoperative position of said first-mentioned pair of leg-engaging members wherein a user supported on said user support assembly can engage lower rearwardly facing leg portions therewith and move said second pair of leg-engaging members thereto from said inoperative position to an extended position spaced inwardly and above the inoperative position of said second pair of leg-engaging members.

11. An exerciser as defined in claim 10, wherein the outer end portion of said user support assembly is constructed and arranged to receive in supported relation thereof an upper arm supporting pad in a position to be engaged by the upper arms of a user supported on said user support assembly and an arm lift unit is provided for enabling a user supported on said user support assembly with upper arms engaged on said upper arm-engaging pad to move said leg-engaging unit from the inoperative position of said first and second pairs of leg-engaging members to the extended positions thereof, said upper arm lift unit including a pair of horizontally aligned and fixedly spaced hand-engaging members and a linkage member extending from said pair of hand-engaging members to said leg-engaging unit in connected relation thereto in spaced relation to a pivotal axis thereof.

12. An exerciser as defined in claim 11, wherein said user support assembly includes:

a user seat member;

a user seat back member;

an elongated support member having one end connected to said upright frame assembly and extending in an operative position generally horizontally outwardly therefrom;

an outer leg structure constructed and arranged to engage and be supported on the horizontal surface in spaced relation to said frame extending in an operative position in supporting relation with respect to said elongated support member to maintain the elongated support member in said generally horizontally outwardly extending relation from said lower frame portion, seat mounting structure constructed and arranged to mount said user seat member for movement horizontally with respect to said elongated support member when in the operative position thereof between an outer position and an inner position and spaced inwardly of and at generally the same level as said outer position;

seat back mounting structure disposed in supporting relation to said seat back member constructed and arranged to be moved between a bench position extending in generally horizontally aligned relation to said user seat member and an upright position extending generally inwardly in inclined relation to said user seat member in response to the movement of said user seat member between the outer and inner positions thereof respectively.

13. An exerciser as defined in claim 12, wherein said elongated support member is pivotally mounted at said one end to said upright frame assembly so as to be moved between the operative position thereof and an upright storage position wherein said elongated support member, said outer leg structure and said seat and seat back members are alongside said upright frame assembly.

14. An exerciser as defined in claim 13, wherein said outer leg structure is fixed to an outer end of said elongated support member and said seat mounting structure comprises a slide frame unit supporting said user seat member slidably mounted on said elongated support member.

15. An exerciser as defined in claim 14, wherein said slide frame unit includes a series of rollers constructed and arranged to roll along said elongated support member, a releasably engageable lock is disposed in operative relation between said slide frame unit and said elongated support member constructed and arranged to releasably lock said user seat member in either of the inner or outer positions thereof.

16. An exerciser as defined in claim 14, wherein said seat back mounting structure includes a pivoted support frame unit supporting said user seat back member pivotally connected to said slide frame unit and a pivoted strut frame pivotally connected between said pivoted support frame unit and said elongated support member.

17. An exerciser as defined in claim 16, wherein said lower frame portion has a pair of horizontally spaced rollers rotatably mounted thereon for rotation about a horizontal axis in a position to facilitate the transport of said exerciser to different locations of use with said elongated support in the storage position thereof by tilting said upright frame assembly in a direction opposed to the direction of the outward extent of said elongated support member when in said operative position.

18. An exerciser as defined in claim 17, wherein said third moving assembly includes a leg-engaging unit pivoted to an outer end portion of said user support assembly with which said third elongated flexible non-extensible element is connected, said leg-engaging unit having a pair of horizontally aligned and fixedly spaced leg-engaging members pivotally movable therewith from a normal inoperative position disposed outwardly of said user support assembly wherein a user supported on said user support assembly in enabled to engage lower forwardly facing portions with legs and move said leg-engaging members thereby from said inoperative position to an extended position spaced upwardly and outwardly from the inoperative position thereof.

19. An exerciser as defined in claim 18, wherein said third moving assembly includes a second pair of horizontally aligned and fixedly spaced leg-engaging members pivotally movable with said leg-engaging unit from a normal inoperative position spaced upwardly and outwardly from the inoperative position of said first-mentioned pair of leg-engaging members wherein a user supported on said user support assembly can engage lower rearwardly facing leg portions therewith and move said second pair of leg-engaging members thereto from said inoperative position to an extended position spaced inwardly and above the inoperative position of said second pair of leg-engaging members.

20. An exerciser as defined in claim 19, wherein the outer end portion of said user support assembly is constructed and arranged to receive in supported relation thereof an upper arm supporting pad in a position to be engaged by the upper arms of a user supported on said user support assembly and an arm lift unit is provided for enabling a user supported on said user support assembly with upper arms engaged on said upper arm-engaging pad to move said leg-engaging unit from the inoperative position of said first and second pairs of leg-engaging members to the extended positions thereof, said upper arm lift unit including a pair of horizontally aligned and fixedly spaced hand-engaging members and a linkage member extending from said pair of hand-engaging members to said leg-engaging unit in connected relation thereto in spaced relation to a pivotal axis thereof.

21. An exerciser as defined in claim 1, wherein said user support assembly includes:

a user seat member;

a user seat back member;

an elongated support member having one end connected to said upright frame assembly and extending in an operative position generally horizontally outwardly therefrom;

an outer leg structure constructed and arranged to engage and be supported on the horizontal surface in spaced relation to said frame extending in an operative position in supporting relation with respect to said elongated support member to maintain the elongated support member in said generally horizontally outwardly extending relation from said lower frame portion, seat mounting structure constructed and arranged to mount said user seat member for movement horizontally with respect to said elongated support member when in the operative position thereof between an outer position and an inner position and spaced inwardly of and at generally the same level as said outer position;

seat back mounting structure disposed in supporting relation to said seat back member constructed and arranged to be moved between a bench position extending in generally horizontally aligned relation to said user seat member and an upright position extending generally inwardly in inclined relation to said user seat member in response to the movement of said user seat member between the outer and inner positions thereof respectively.

22. An exerciser as defined in claim 21, wherein said elongated support member is pivotally mounted at said one end to said upright frame assembly so as to be moved between the operative position thereof and an upright storage position wherein said elongated support member, said outer leg structure and said seat and seat back members are alongside said upright frame assembly.

23. An exerciser as defined in claim 22, wherein said outer leg structure is fixed to an outer end of said elongated support member and said seat mounting structure comprises a slide frame unit supporting said user seat member slidably mounted on said elongated support member.

24. An exerciser as defined in claim 23, wherein said slide frame unit includes a series of rollers constructed and arranged to roll along said elongated support member, a releasably engageable lock is disposed in operative relation between said slide frame unit and said elongated support member constructed and arranged to releasably lock said user seat member in either of the inner or outer positions thereof.

25. An exerciser as defined in claim 23, wherein said seat back mounting structure includes a pivoted support frame unit supporting said user seat back member pivotally connected to said slide frame unit and a pivoted strut frame pivotally connected between said pivoted support frame unit and said elongated support member.

26. An exerciser as defined in claim 25, wherein said lower frame portion has a pair of horizontally spaced rollers rotatably mounted thereon for rotation about a horizontal axis in a position to facilitate the transport of said exerciser to different locations of use with said elongated support in the storage position thereof by tilting said upright frame assembly in a direction opposed to the direction of the outward extent of said elongated support member when in said operative position.

27. An exerciser as defined in claim 26, wherein said third moving assembly includes a leg-engaging unit pivoted to an outer end portion of said user support assembly with which said third elongated flexible non-extensible element is connected, said leg-engaging unit having a pair of horizontally aligned and fixedly spaced leg-engaging members pivotally movable therewith from a normal inoperative position disposed outwardly of said user support assembly wherein a user supported on said user support assembly in enabled to engage lower forwardly facing portions with legs and move said leg-engaging members thereby from said inoperative position to an extended position spaced upwardly and outwardly from the inoperative position thereof.

28. An exerciser as defined in claim 27, wherein said third moving assembly includes a second pair of horizontally aligned and fixedly spaced leg-engaging members pivotally movable with said leg-engaging unit from a normal inoperative position spaced upwardly and outwardly from the inoperative position of said first-mentioned pair of leg-engaging members wherein a user supported on said user support assembly can engage lower rearwardly facing leg portions therewith and move said second pair of leg-engaging members thereto from said inoperative position to an extended position spaced inwardly and above the inoperative position of said second pair of leg-engaging members.

29. An exerciser as defined in claim 28, wherein the outer end portion of said user support assembly is constructed and arranged to receive in supported relation thereof an upper arm supporting pad in a position to be engaged by the upper arms of a user supported on said user support assembly and an arm lift unit is provided for enabling a user supported on said user support assembly with upper arms engaged on said upper arm-engaging pad to move said leg-engaging unit from the inoperative position of said first and second pairs of leg-engaging members to the extended positions thereof, said upper arm lift unit including a pair of horizontally aligned and fixedly spaced hand-engaging members and a linkage member extending from said pair of hand-engaging members to said leg-engaging unit in connected relation thereto in spaced relation to a pivotal axis thereof.

30. An exerciser comprising:

an upright frame assembly constructed and arranged to be disposed in an operative position supported on a horizontal surface, said upright frame assembly having a user support assembly constructed and arranged to support a user thereon;

exercising assemblies on said upright frame assembly constructed and arranged to be moved through exercising strokes by a user;

said user support assembly including a user seat member;

a user seat back member;

an elongated support member having one end connected to said upright frame assembly and extending in an operative position generally horizontally outwardly therefrom;

an outer leg structure constructed and arranged to engage and be supported on the horizontal surface in spaced relation to said frame extending in an operative position in supporting relation with respect to said elongated support member to maintain the elongated support member in said generally horizontally outwardly extending relation from said lower frame portion, seat mounting structure constructed and arranged to mount said user seat member for movement horizontally with respect to said elongated support member when in the operative position thereof between an outer position and a inner position and spaced inwardly of and at generally the same level as said outer position;

seat back mounting structure operatively associated with said seat back member constructed and arranged to enable said seat back member to be selectively retained in a bench position extending in generally horizontally aligned relation to said user seat member in an outer position thereof and an upright position extending generally inwardly in inclined relation to said user seat member in an inner position thereof, said upright frame assembly including a lower frame portion constructed and arranged to be stablely supported on a horizontal surface, an upstanding portion extending upwardly from said lower frame portion, and a seat support portion extending upwardly from said lower frame portion in horizontally spaced relation to said upstanding portion, said elongated support member being pivotally mounted on said seat support portion so as to be moved between the operative position thereof and an upright storage position wherein said elongated support member, said outer leg structure and said user seat and seat back members are alongside said upstanding portion.

31. An exerciser as defined in claim 30, wherein said outer leg structure is fixed to an outer end of said elongated support member and said. seat mounting structure comprises a slide frame unit supporting said user seat member slidably mounted on said elongated support member.

32. An exerciser as defined in claim 31, wherein said slide frame unit includes a series of rollers constructed and arranged to roll along said elongated support member, a releasably engageable lock is disposed in operative relation between said slide frame unit and said elongated support member constructed and arranged to releasably lock said user seat member in either of the inner or outer positions thereof.

33. An exerciser as defined in claim 32, wherein said seat back mounting structure includes a pivoted support frame unit supporting said user seat back member pivotally connected to said slide frame unit and a pivoted strut frame pivotally connected between said pivoted support frame unit and said elongated support member.

34. An exerciser as defined in claim 33, wherein said lower frame portion has a pair of horizontally spaced rollers rotatably mounted thereon for rotation about a horizontal axis in a position to facilitate the transport of said exerciser to different locations of use with said elongated support in the storage position thereof by tilting said upright frame assembly in a direction opposed to the direction of the outward extent of said elongated support member when in said operative position.

35. An exerciser as defined in claim 30, wherein said seat back mounting structure is constructed and arranged to enable the seat back member to be moved between the bench position and the upright position thereof in response to the movement of said user seat member between the outer and inner positions thereof respectively.

* * * * *